US009799959B2

(12) United States Patent
Ko et al.

(10) Patent No.: US 9,799,959 B2
(45) Date of Patent: Oct. 24, 2017

(54) ANTENNA DEVICE

(71) Applicant: Samsung Electronics Co., Ltd., Suwon-si (KR)

(72) Inventors: Seung-Tae Ko, Bucheon-si (KR); Yoon-Geon Kim, Busan (KR); Kwang-Hyun Baek, Anseong-si (KR); Won-Bin Hong, Seoul (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 86 days.

(21) Appl. No.: 14/819,005

(22) Filed: Aug. 5, 2015

(65) Prior Publication Data

US 2016/0043470 A1 Feb. 11, 2016

(30) Foreign Application Priority Data

Aug. 5, 2014 (KR) ..... 10-2014-0100691

(51) Int. Cl.

| | |
|---|---|
| ***H01Q 1/38*** | (2006.01) |
| ***H01Q 1/24*** | (2006.01) |
| ***H01Q 9/04*** | (2006.01) |
| ***H01Q 3/24*** | (2006.01) |
| ***H01Q 21/24*** | (2006.01) |
| ***H01Q 21/28*** | (2006.01) |

(52) U.S. Cl.

CPC ..... *H01Q 9/045* (2013.01); *H01Q 3/24* (2013.01); *H01Q 9/0414* (2013.01); *H01Q 21/24* (2013.01); *H01Q 21/28* (2013.01)

(58) Field of Classification Search

CPC ..... H01Q 3/24; H01Q 21/28; H01Q 21/24; H01Q 9/045; H01Q 9/0414; H01Q 1/24; H01Q 1/38

USPC ..... 343/843, 702, 700 MS, 829, 846, 876

See application file for complete search history.

(56) References Cited

U.S. PATENT DOCUMENTS 5,319,377 A * 6/1994 Thomas ..... H01Q 13/085 343/700 MS
6,008,763 A * 12/1999 Nystrom ..... H01Q 21/08 343/700 MS
6,147,649 A * 11/2000 Ivrissimtzis ..... H01Q 1/243 343/700 MS
6,198,439 B1 * 3/2001 Dufrane ..... H01Q 1/22 343/700 MS (Continued)

FOREIGN PATENT DOCUMENTS

JP 2000-114992 A 4/2000

OTHER PUBLICATIONS

International Search Report corresponding to International Application No. PCT/KR2015/008206, Oct. 29, 2015.

(Continued)

*Primary Examiner* — Tho G Phan

(74) *Attorney, Agent, or Firm* — McAndrews, Held & Malloy, Ltd.

(57) ABSTRACT

According to various embodiments, an antenna device may include: a board unit; a power feeding unit provided in the board unit; and radiation units connected to the power feeding unit to be fed with a power feeding signal. The radiation units may be provided to face each other within a width of the board unit along a periphery of the board unit. The device as described above may be implemented more variously according to embodiments.

36 Claims, 23 Drawing Sheets

(56) References Cited

U.S. PATENT DOCUMENTS

| | | | | |
|---|---|---|---|---|
| 6,295,028 | B1 * | 9/2001 | Jonsson | H01Q 1/246 343/700 MS |
| 2005/0179593 | A1 | 8/2005 | Oshima et al. | |
| 2006/0132373 | A1 | 6/2006 | Yuanzhu | |
| 2009/0284440 | A1 * | 11/2009 | Weidmann | H01Q 21/065 343/893 |
| 2010/0245155 | A1 | 9/2010 | Miyazato et al. | |
| 2012/0081252 | A1 * | 4/2012 | Pan | H01Q 1/36 343/700 MS |
| 2012/0287019 | A1 | 11/2012 | Sudo et al. | |
| 2013/0147664 | A1 | 6/2013 | Lin | |
| 2013/0176189 | A1 * | 7/2013 | Kodama | H01Q 1/243 343/876 |
| 2013/0257672 | A1 | 10/2013 | Lu et al. | |
| 2014/0009364 | A1 | 1/2014 | Yehezkely | |
| 2015/0145729 | A1 * | 5/2015 | Pintos | H01Q 9/0414 343/700 MS |

OTHER PUBLICATIONS

Written Opinion of the International Searching Authority corresponding to International Application No. PCT/KR2015/008206, Oct. 29, 2015.

* cited by examiner

| | the second power feeding line | the first power feeding line |
|---|---|---|
| Vertical Polarization Radiation Pattern | ON | Off |
| Horizontal Polarization Radiation Pattern | Off | ON |
| Diagonal Polarization Radiation Pattern | ON | ON |
| Circular Polarization Radiation Pattern | ON | ON+90° |

ANTENNA DEVICE

CROSS-REFERENCE TO RELATED APPLICATION

This application claims the priority under 35 U.S.C. §119(a) to Korean Application Serial No. 10-2014-0100691, which was filed in the Korean Intellectual Property Office on Aug. 5, 2014, the entire content of which is hereby incorporated by reference.

TECHNICAL FIELD

Various embodiments of the present disclosure relate to an antenna device.

BACKGROUND

Recently, wireless communication techniques have been implemented by various methods, such as Wireless Local Area Network (W-LAN) represented by Wi-Fi technique, Bluetooth, and near field communication (NFC), in addition to commercial mobile communication network connection. Mobile communication services were initiated from a first generation mobile communication service centered on voice communication, and have gradually been developed to a super-high speed and large capacity service (e.g., a high quality video streaming service). It is expected that a next generation mobile communication service, which is to be commercially available in the future, will be provided through an ultra-high frequency band of dozens of GHz or more (hereinafter, the communication may be referred to as "mm-wave communication").

The wavelength of a resonance frequency of an antenna device to be used for the mm-wave communication is in a mere range of 1 mm to 10 mm, and the size of a radiator may be further reduced. In addition, in the antenna device used for mm-wave communication, a Radio Frequency Integrated Circuit (RFIC) chip mounted with a communication circuit unit and a radiator may be arranged to be close to each other in order to suppress transmission loss occurring between the communication circuit and the radiator. Such an antenna device may be implemented in a modular form by arranging the RFIC chip and the radiator on a printed circuit board having a width and a length that do not exceed 30 mm, for example, a size of about 10 mm*25 mm.

In general, an operating frequency may be determined depending on the length of the radiator, and as the operating frequency band increases, the size of the antenna device, for example, the size of the radiator that performs a direct radiation operation of wireless signals may decrease. Assuming that a resonance frequency of the antenna device is $\lambda$, it means that the radiator may have an electric length of $N*(\lambda/4)$. Here, N means a natural number. In a case where such an antenna device is mounted in a miniaturized, thinned, and light-weight electronic device, such as a mobile communication terminal, being under mounting space constraints is unavoidable. In particular, the antenna device is mounted within the electronic device in consideration of the radiation performance of the antenna device. Especially, in order to ensure a 360° coverage at the time of mm-wave communication, the antenna device is mounted on an edge portion, such as a corner portion of the circuit board. Since the electronic device have a very thin thickness as compared to the longitudinal size thereof, the antenna device mounted in the electronic device may be easily mounted in the longitudinal direction. That is, the radiator of the antenna device mounted in the electronic device may be easily formed to have a length corresponding to the frequency band in the longitudinal direction. Thus, a radiator having a polarized wave in the longitudinal direction (hereinafter, referred to as a "horizontally polarized wave") may be easily mounted in an electronic device, may allow easy frequency design, and may have a good radiation efficiency. However, since the electronic device does not provide a sufficient length for allowing the mounting of the radiator of the antenna in the thickness direction of the electronic device, it is not easy to implement a polarized wave in the thickness direction (hereinafter, referred to as a "vertically polarized wave") as well as to design a required frequency.

In addition, when a plurality of antenna modules are installed along the periphery of a board, a polarization loss occurs due to the interference between adjacent antenna modules. Thus, when the plurality of antenna modules are mounted, it is necessary for the antenna modules to be spaced apart from each other by a predetermined interval which unavoidably causes the integration of the antenna modules to be degraded.

SUMMARY

Accordingly, various embodiments of the present disclosure are to provide an antenna device capable of securing various operating characteristics without being under mounting space restraints.

In addition, various embodiments of the present disclosure are to provide an antenna device capable of transmitting/receiving vertically polarized waves in a width direction having a very thin thickness as compared to a longitudinal direction as well as performing transmission/reception of horizontally polarized waves that are easily provided in the longitudinal direction of an electronic device.

Furthermore, various embodiments of the present disclosure are to provide an antenna device capable of minimizing the polarization loss even if antenna modules are provided to be close to each other, and improving the integration degree of antenna modules.

According to one embodiment among various embodiments of the present disclosure, an antenna device may include: a board unit; and a radiator arranged in a width direction along a periphery of the board unit to generate an electric field and a magnetic field in the width direction.

In addition, according to one embodiment among various embodiments of the present disclosure, an antenna device may include: a board unit; a power feeding unit provided in the board unit; and radiation units connected to the power feeding unit to be fed with a power feeding signal, the radiation units being provided to face each other within a width of the board unit along a periphery of the board unit.

In addition, according to one of various embodiments of the present disclosure, an antenna device may include: a board unit; a power feeding unit provided in the board unit; and first and second radiators connected to the power feeding unit to be provided with a power feeding signal, the first and second radiators being provided to face each other along a periphery of the board unit and within a width of the board unit. The first radiator may include a radiation patch connected with the power feeding unit and protruding in a longitudinal direction of the board unit, the second radiator may include first and second radiation patches spaced apart from the first radiator to face the first radiator parallel to the first radiator above and below the first radiator, and the first radiator and the second radiator may generate a vertical polarization radiation pattern.

In addition, according to one of various embodiments of the present disclosure, an antenna device may include: a board unit; a power feeding unit provided in the board unit; and first and second radiators connected to the power feeding unit to be provided with a power feeding signal, positioned on a peripheral surface of the board unit, and provided to face the peripheral surface of the board unit and face each other within a width of the board unit. The first radiator may include a column portion formed to be spaced apart from an end of the board unit and connected with the power feeding unit, and plates protruding from opposite ends of the column portion toward the board unit, the second radiator may include a plurality of radiation patches protruding toward the column portion along a width direction of the board unit, and the first radiator and the second radiator may generate a vertical polarization radiation pattern.

In addition, according to one of various embodiments of the present disclosure, an antenna device may include: a board unit; a power feeding unit provided in the board unit; radiation members connected to the power feeding unit to be provided with a power feeding signal, and provided to face each other along a periphery of the board unit and within a width of the board unit; and one or more guide radiation members provided in a direction away from the peripheral surface of the board unit, and arranged close to the radiation members. The radiation members may generate a vertical polarization radiation pattern, and the guide radiation member adjusts a directivity of the antenna device.

In addition, according to one of various embodiments of the present disclosure, an antenna device may include: a board unit; a power feeding unit provided in the board unit; and first and second radiation patches connected to the power feeding unit to be supplied with a power feeding signal, and provided to face each other along a periphery of the board unit and within a width of the board unit, the first and second radiation patches generating an electric field in a direction horizontal to the board unit and an electric field in a direction vertical to the board unit so as to generate a horizontal polarization antenna pattern and a vertical polarization antenna pattern.

Further, according to one of various embodiments of the present disclosure, an antenna device may include: a board unit; a power feeding unit provided in the board unit; and first and second radiators connected to the power feeding unit to be provided with a power feeding signal, positioned on a peripheral surface of the board unit, and provided to face the peripheral surface of the board unit and face each other within a width of the board unit. The power feeding unit may include a first power feeding line connected to the first radiator to provide a horizontal polarization power feeding signal between the first radiator and the second radiator, and a second power feeding line connected to the first radiator to provide a vertical polarization power feeding signal between the first radiator and the second radiator. At least one of a vertical polarization radiation pattern, a horizontal polarization radiation pattern, a diagonal polarization radiation pattern, and a circular polarization radiation pattern may be generated according to selective ON/OFF of the first and second power feeding lines.

According to various embodiments of the present disclosure, an antenna device according to present disclosure may be mounted within a mounting space that is narrow in width direction of an electronic device, such as a mobile communication terminal, to be capable of transmitting/receiving vertically polarized waves.

In connection with an operating frequency, it is possible to implement an antenna device capable of securing various operating characteristics without being restricted by a mounting space. For example, it is possible to implement an antenna device that enables the transmission/reception of vertically polarized waves by adjusting a horizontal length of an antenna, and enables transmission/reception of vertically polarized waves, transmission/reception of wideband circularly polarized waves and dual power feeding.

In addition, even if antenna devices are mounted close to each other along an edge of an electronic device, a polarization loss can be minimized and a mounting distance between an antenna module and a neighboring antenna device can be minimized, and the integration degree of antenna devices can be improved.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1A:
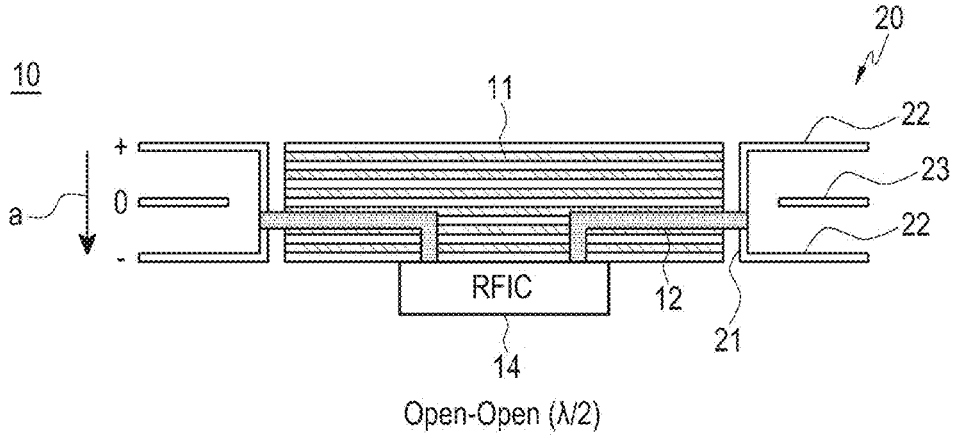
FIGS. 1A and 1B are views illustrating a radiation unit that has an open-stub structure in an antenna device according to one embodiment among various embodiments of the present disclosure.

Hereinafter, various embodiments of the present disclosure will be described with reference to the accompanying drawings. The present disclosure may have various embodiments, and modifications and changes may be made therein. Therefore, the present disclosure will be described in detail with reference to particular embodiments shown in the accompanying drawings. However, it should be understood that there is no intent to limit various embodiments of the present disclosure to the particular embodiments disclosed herein, but the present disclosure should be construed to cover all modifications, equivalents, and/or alternatives falling within the spirit and scope of the various embodiments of the present disclosure. In the description of the drawings, identical or similar reference numerals are used to designate identical or similar elements.

As used in various embodiments of the present disclosure, the expressions "include", "may include" and other conjugates refer to the existence of a corresponding disclosed function, operation, or constituent element, and do not limit one or more additional functions, operations, or constituent elements. Further, as used in various embodiments of the present disclosure, the terms "include", "have", and their conjugates are intended merely to denote a certain feature, numeral, step, operation, element, component, or a combination thereof, and should not be construed to initially exclude the existence of or a possibility of addition of one or more other features, numerals, steps, operations, elements, components, or combinations thereof.

Further, as used in various embodiments of the present disclosure, the expression "or" includes any or all combinations of words enumerated together. For example, the expression "A or B" may include A, may include B, or may include both A and B.

While expressions including ordinal numbers, such as "first" and "second", as used in various embodiments of the present disclosure may modify various constituent elements, such constituent elements are not limited by the above expressions. For example, the above expressions do not limit the sequence and/or importance of the elements. The above expressions are used merely for the purpose of distinguishing an element from the other elements. For example, a first user device and a second user device indicate different user devices although both of them are user devices. For example, a first element may be termed a second element, and likewise a second element may also be termed a first element without departing from the scope of various embodiments of the present disclosure.

It should be noted that if it is described that an element is "coupled" or "connected" to another element, the first element may be directly coupled or connected to the second element, and a third element may be "coupled" or "connected" between the first and second elements. Conversely, when one component element is "directly coupled" or "directly connected" to another component element, it may be construed that a third component element does not exist between the first component element and the second component element.

The terms as used in various embodiments of the present disclosure are merely for the purpose of describing particular embodiments and are not intended to limit the various embodiments of the present disclosure. As used herein, the singular forms are intended to include the plural forms as well, unless the context clearly indicates otherwise.

Unless defined otherwise, all terms used herein, including technical terms and scientific terms, have the same meaning as commonly understood by a person of ordinary skill in the art to which various embodiments of the present disclosure pertain. Such terms as those defined in a generally used dictionary are to be interpreted to have the meanings equal to the contextual meanings in the relevant field of art, and are not to be interpreted to have ideal or excessively formal meanings unless clearly defined in various embodiments of the present disclosure.

An electronic device according to various embodiments of the present disclosure may be a device having a function that is provided through various colors emitted depending on the states of the electronic device or a function of sensing a gesture or bio-signal. For example, the electronic device may include at least one of a smart phone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (e.g., a head-mounted-device (HMD) such as electronic glasses, electronic clothes, an electronic bracelet, an electronic necklace, an electronic appcessory, an electronic tattoo, or a smart watch).

According to some embodiments, the electronic device may be a smart home appliance having a function serviced by light that emits various colors depending on the states of the electronic device or a function of sensing a gesture or bio-signal. The smart home appliance as an example of the electronic device may include at least one of, for example, a television, a Digital Video Disc (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, and an electronic picture frame.

According to some embodiments, the electronic device may include at least one of various medical appliances (e.g., magnetic resonance angiography (MRA), magnetic resonance imaging (MRI), computed tomography (CT), and ultrasonic equipment), navigation equipment, a global positioning system (GPS) receiver, an event data recorder (EDR), a flight data recorder (FDR), automotive infotainment device, electronic equipment for ships (e.g., ship navigation equipment and a gyrocompass), avionics, security equipment, a vehicle head unit, an industrial or home robot, an automatic teller machine (ATM) of a banking system, and a point of sales (POS) of a shop.

According to some embodiments, the electronic device may include at least one of a part of furniture or a building/structure, an electronic board, an electronic signature receiving device, a projector, and various kinds of measuring instruments (e.g., a water meter, an electric meter, a gas meter, and a radio wave meter), each of which has a function that is provided through various colors emitted depending on the states of the electronic device or a function of sensing a gesture or bio-signal. The electronic device according to various embodiments of the present disclosure may be a combination of one or more of the aforementioned various devices. Further, the electronic device according to various embodiments of the present disclosure may be a flexible device. Further, it will be apparent to those skilled in the art that the electronic device according to various embodiments of the present disclosure is not limited to the aforementioned devices.

Hereinafter, an electronic device according to various embodiments of the present disclosure will be described with reference to the accompanying drawings. The term "user" as used in various embodiments of the present disclosure may refer to a person who uses an electronic device or a device (e.g., artificial intelligence electronic device) that uses an electronic device.

Hereinafter, a concept of an antenna device according to various embodiments of the present disclosure may be described with reference to FIGS. 1 and 2, an antenna device according to a first embodiment among various embodiments of the present disclosure may be described with reference to FIGS. 3 to 8, an antenna device according to a second embodiment among various embodiments of the present disclosure may be described with reference to FIGS. 9 to 12, an antenna device according to a third embodiment among various embodiments of the present disclosure may be described with reference to FIGS. 13 to 17, an antenna device according to a fourth embodiment among various embodiments of the present disclosure may be described with reference to FIGS. 18 to 23, and an antenna device according to a fifth embodiment among various embodiments of the present disclosure may be described with reference to FIGS. 24 to 30.

Figure 1B:
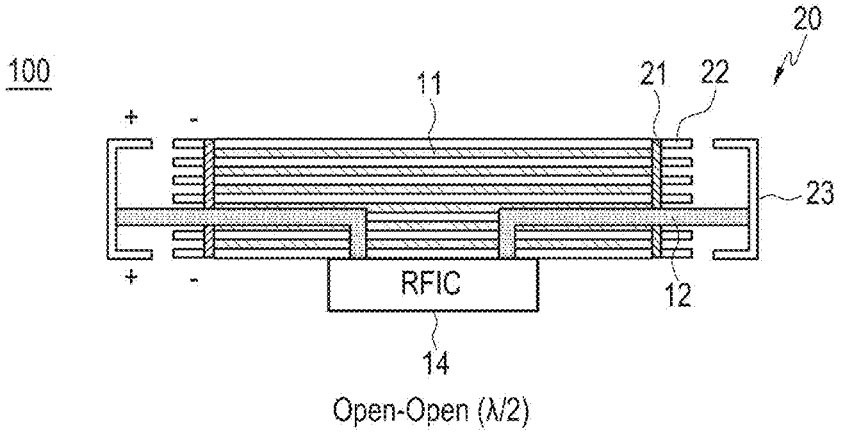
Figure 2A:
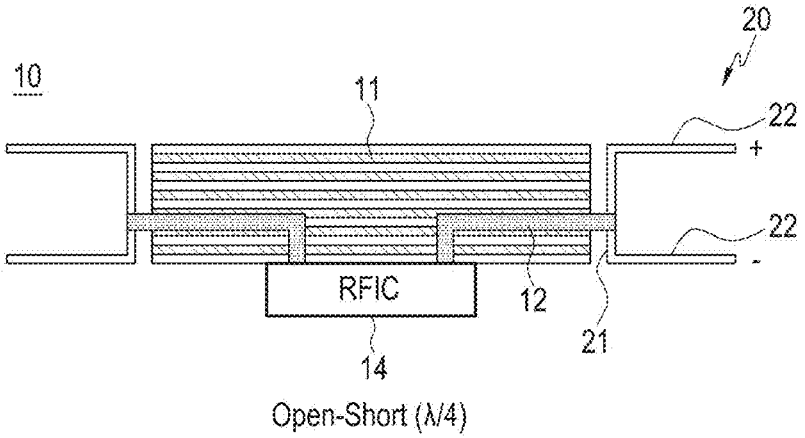
FIGS. 2A to 2C are views illustrating a radiation unit that has a short-stub structure in the antenna device according to one embodiment among various embodiments of the present disclosure.
Figure 2B:
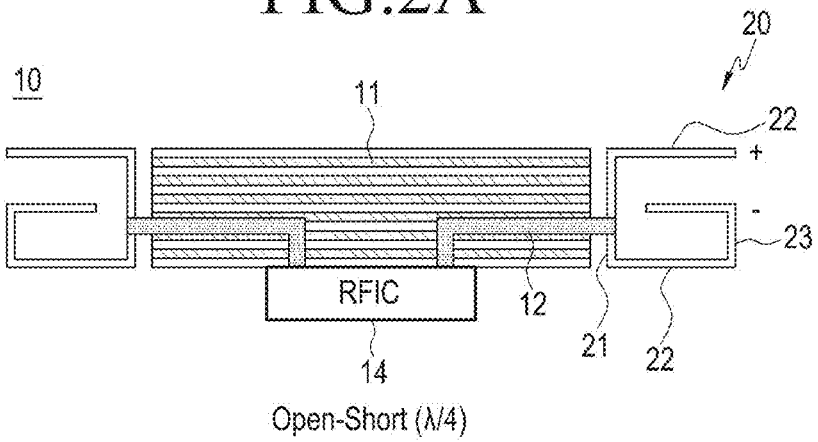
Figure 2C:
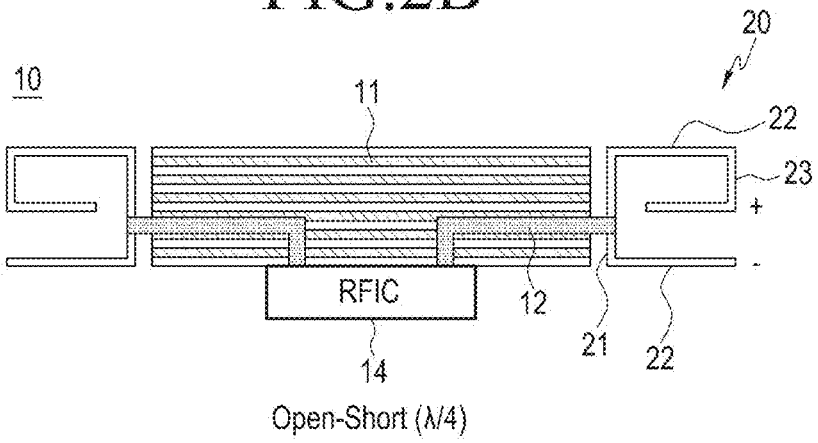

FIGS. 1A and 1B are views illustrating a radiation unit 20 that has an open-stub structure in an antenna device 10 according to one embodiment among various embodiments of the present disclosure, and FIGS. 2A to 2C are views illustrating a radiation unit 20 that has a short-stub structure in the antenna device 10 according to one embodiment among various embodiments of the present disclosure.

Referring to FIGS. 1A and 1B and FIGS. 2A to 2C, the antenna device 10 according to various embodiments of the present disclosure may include a board unit 11, a power feeding unit 12, and a radiation unit 20.

The board unit 11 may be formed of, e.g., a flexible printed circuit board or a dielectric board, in which a plurality of layers are laminated. Each of the layers may include via holes formed or defined to penetrate a printed circuit pattern formed of a conductive material, a ground layer, or front and rear surfaces (or top and bottom surfaces) thereof.

In general, the via holes (not illustrated in FIGS. 1 and 2) formed in the multi-layered circuit board are formed for the purpose of electrical connection of printed circuit patterns formed in different layers or heat radiation. According to the embodiments of the present disclosure, the antenna device 10 may include via holes arranged in a grid form in a portion of the board unit 11 or portions spaced apart from each other in the board unit 11 and laminated to be connected with each other in a width direction so that the via holes may be utilized as a radiation member in the width direction (a "column portion" in the present disclosure may correspond to the radiation member and will be referred to as a "radiation column member 21" below).

In a certain embodiment, each of the layers forming the board unit 11 may include a plurality of via holes arranged in one direction (hereinafter, referred to as a "horizontal direction") in some regions, for example, a region adjacent to an edge. When the respective layers are laminated to form the board unit 11, via holes formed in one of the layers (first layer) may be aligned with the via holes formed in another layer (second layer) adjacent to the first layer. The via holes of the first layer and the via holes of the second layer may be arranged in straight lines. Between the via holes of the first layer and the via holes of the second layer, via pads may be arranged, respectively, so that a stable connection may be provided between each two via holes arranged in the different layers and adjacent to each other.

The radiation column member 21 is formed by via holes within or adjacent to the board unit 11 such that, for example, a radiator 23 or a radiation patch 22 to be described later is arranged in a direction vertical to the radiation column member 21. Thus, the radiation column member 21 may be connected to a communication circuit unit or a ground unit GND even though, for example, a separate connection member is not disposed. That is, a power feeding line or a ground line of a power feeding unit 12 may be connected to the radiation column member 21 while the board unit 11 is fabricated.

The power feeding unit 12 may be connected to one of the via holes so as to provide power feeding signals from an RFIC chip 14 configured in the board unit 11. In addition, some of the via holes or via pads that form the radiation column member 21, for example, at least one via pad, may provide a ground to the radiation unit 20 so as to suppress the leakage of the power feeding signals. The power feeding unit 12 or the ground unit GND may be configured in a layer positioned on a surface of the board unit 11.

Radiation units 20 may be provided along the periphery of the board unit 11 to be opposed to each other within the width of the board unit 11 and may be connected to the power feeding unit 12 to be provided with the power feeding signals. In particular, the radiation units 20 according to various embodiments of the present disclosure may be installed in the width direction having a very thin thickness as compared to the longitudinal size of the board unit 11 so as to implement a vertical polarization radiation pattern, and may have a cavity antenna structure. More specifically, according to, e.g., lamination or shape, the radiation units 20 may have an open-stub structure that is opened-opened. Otherwise, the radiation units 20 may have a short-stub structure that is opened-shorted.

More specifically, referring to FIGS. 1A and 1B, according to one embodiment among various embodiments of the present disclosure, the radiation unit 20 may include a radiator 23 and a plurality of radiation patches 22 to form an open stub structure. The radiation patches 22 may be formed to protrude in a direction (Y-axis direction) horizontal to the top and bottom surfaces of the board unit 11 at the opposite ends of the radiation column member 21 provided in the width direction (Z-axis direction) of the board unit 11 in a flat plate shape having a predetermined area. More specifically, the radiator 23 may be formed to be in point contact with the power feeding unit 12, and to protrude in a direction perpendicular to a peripheral surface in the width between the top and bottom surfaces of the board unit 11. In addition, the radiation patches 22 may be disposed on the top and bottom surfaces of the board unit 11, respectively. That is, the radiator 23 may be provided between an upper radiation patch 22 and a lower radiation patch 22 having a predetermined width in the vertical direction at the top and bottom portions of the radiation column member 21 provided along the peripheral surface of the board unit 11. Thus, the space between the upper radiation patch 22 and the radiator 23 is opened and the space between lower radiation patch 22 and the radiator 23 is opened, so that the radiation unit may have an open stub structure. At this time, the length of the radiation patches 22 may have an electric length of $N*(\lambda/2)$. Here, N means a natural number and $\lambda$ means a resonance frequency of the antenna device 10. When a current is applied to the antenna device 10 having such a structure, a vertical electric field may be generated from the radiation patches 22 and radiated from the opened regions so that the antenna device 10 may have a horizontal radiation characteristic.

Referring to FIGS. 2A to 2C, according to one embodiment among various embodiments of the present disclosure, a radiation unit 20 may include radiation patches 22 arranged to face each other on a radiation column member 21 so as to form a short stub structure. More specifically, as illustrated in FIG. 2A, two radiation patches 22 may be disposed within the width of a board unit 11, more specifically at the opposite ends of the radiation column member 21 to face each other. In addition, as illustrated in FIG. 2B or 2C, the upper and lower radiation patches 22 may be provided such that one of the radiation patches 22 is formed as if it is bent by a radiator 23 extending an end thereof to be close to and face another radiation patch 22. Thus, the radiation unit 20 may have an open-short stub structure, in which one ends of the upper radiation patch 22 and the lower radiation patch 22 are shorted and the other ends thereof are opened. At this time, the radiation patches 22 may have an electric length of $N*(\lambda/4)$. Here, N means a natural number and $\lambda$ means a resonance frequency of the antenna device 10. When a current applied to the antenna device 10 having such a structure, a vertical electric field may be generated between the radiation patches 22 and radiated in the opened region so that the antenna device may have a horizontal radiation characteristic.

Hereinafter, an antenna device 100 according to a first embodiment will be described with reference to FIGS. 3 to 8.

Figure 3:
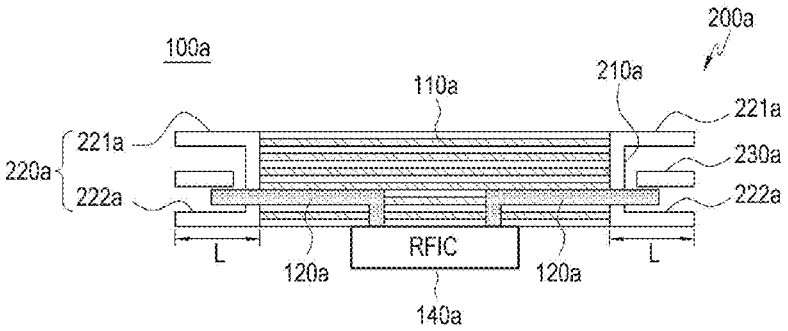
FIG. 3 is a sectional view schematically illustrating an antenna device according to a first embodiment among various embodiments of the present disclosure.
Figure 4:
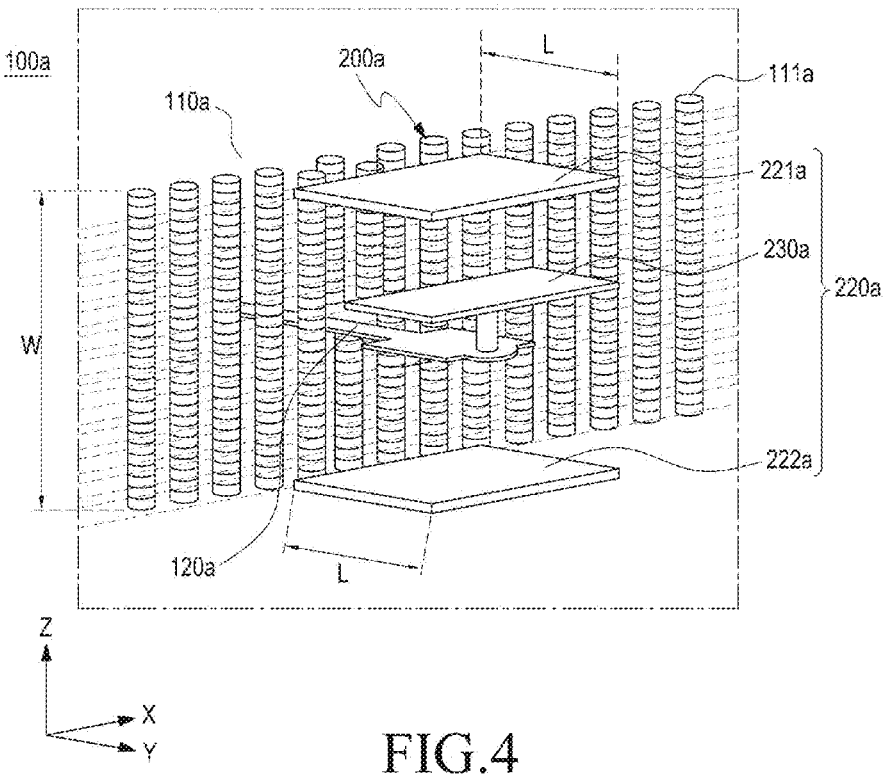
FIG. 4 is a perspective view schematically illustrating the antenna device according to the first embodiment among various embodiments of the present disclosure.
Figure 5:
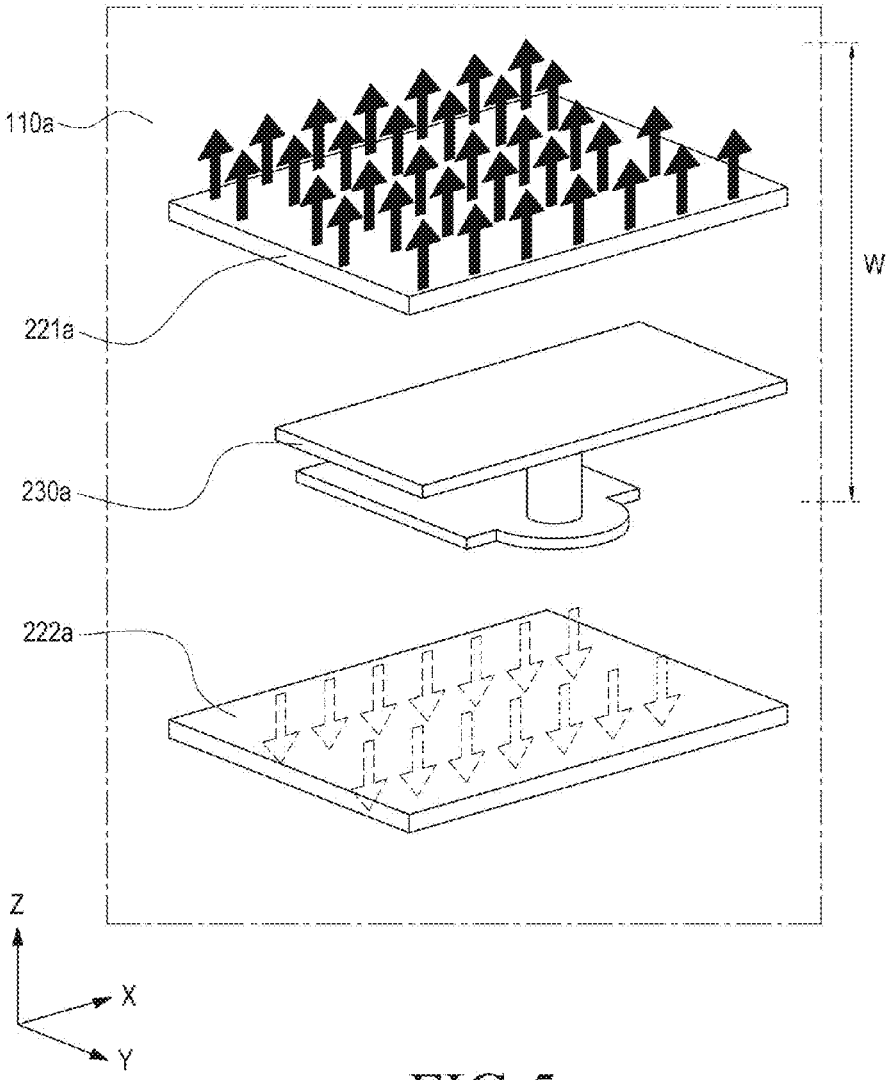
FIG. 5 is a view illustrating a vertical polarization radiation pattern generated in a radiation unit in the antenna device according to the first embodiment among various embodiments of the present disclosure.

FIG. 3 is a sectional view schematically illustrating an antenna device 100*a* according to the first embodiment among various embodiments of the present disclosure. FIG. 4 is a perspective view schematically illustrating the antenna device 100*a* according to the first embodiment among various embodiments of the present disclosure. FIG. 5 is a view illustrating a vertical polarization radiation pattern generated in a radiation unit 200*a* in the antenna device 100*a* according to the first embodiment among various embodiments of the present disclosure.

Referring to FIGS. 3 to 5, the antenna device according to the first embodiment has the same configuration as the antenna device illustrated in FIG. 1A described above, and corresponds to an embodiment of an open stub structure among the antenna devices of the present disclosure.

As described above, the antenna device 100*a* according to the first embodiment may include a board unit 110*a*, a power feeding unit 120*a*, and a radiation unit 200*a*.

The board unit 110*a* may be formed of a multi-layered circuit board having a plurality of laminated layers. The multi-layered circuit board may include a plurality of via holes 111*a*. The via holes 111*a* may be provided in order to electrically connect printed circuit boards formed on different layers, or for the purpose of heat radiation. The via holes 111*a* may also be formed to penetrate a ground layer, a front surface (or a top surface), and a rear surface (or a bottom surface) of the multi-layered circuit board.

The radiation unit 200*a* may be provided with power feeding signals from an RFIC chip 140*a* via the power feeding unit 120*a*. The radiation unit 200*a* may be positioned on a peripheral surface of the board unit 110*a*, and may include a first radiator 230*a* and a second radiator 220*a* that are disposed to face each other, and that may be in parallel to each other within the width of the board unit 110*a*.

The first radiator 230*a* is connected with the power feeding unit 120*a*, and may be provided as a radiation patch 230*a* protruding while having a predetermined area in a direction (Y-axis direction) horizontal to the length of the board unit 110*a* (having an area in the X-Y plane direction). As described above, the radiation patch 230*a* according to the first embodiment may have a predetermined area in the longitudinal direction of the board unit 110*a* on the peripheral surface of the board unit 110*a*. In addition, the radiation patch (the first radiator) 230*a* may be placed between a first radiation patch 221*a* and a second radiation patch 222*a* (of the second radiator 220*a*) to be described later. As the radiation patch 230*a* is disposed between the first radiation patch 221*a* and the second radiation patch 222*a* as described above, the radiation unit 200 may have the open stub structure described above.

The second radiator 220*a* may be provided to have an open stub structure to face the radiation patch 230*a*. More specifically, the radiator 220*a* may include the first radiation patch 221*a* and the second radiation patch 222*a* which may be provided on the top and bottom surfaces of the board unit 110*a* to be spaced apart from each other by the width of the board unit and to face each other. The first radiation patch 221*a* and the second radiation patch 222*a* may be disposed such that the first radiator 230*a* is interposed therebetween and the first radiation patch 221*a* and the second radiation patch 222*a* are parallel to the top and bottom surfaces of the first radiator 230*a*, respectively. The first radiation patch 221*a* and the second radiation patch 222*a* are electrically connected with each other via a radiation column member 210*a* formed by the via holes 111*a* laminated in multiple layers in the width direction of the board unit 110*a* to be connected with each other.

When power feeding signals are applied through the power feeding unit 120*a*, the first radiation patch 221*a* may generate a first electric field in a direction vertical to a first surface of the first radiation patch 221*a*, and the second radiation patch 222*a* may generate a second electric field in a direction vertical to a second surface of the second radiation patch 222*a*. Accordingly, a vertically polarized wave may be generated according to the vertical electric field generated between the first radiation patch 221*a* and the first radiator 230*a*, and according to the vertical electric field generated between the second radiation patch 222*a* and the first radiator 230*a*. A horizontal radiation characteristic may also be provided through the open regions between the first radiation patch 221*a* and the radiation patch 230*a*, and between the second radiation patch 222*a* and the radiation patch 230*a*.

Figure 6:
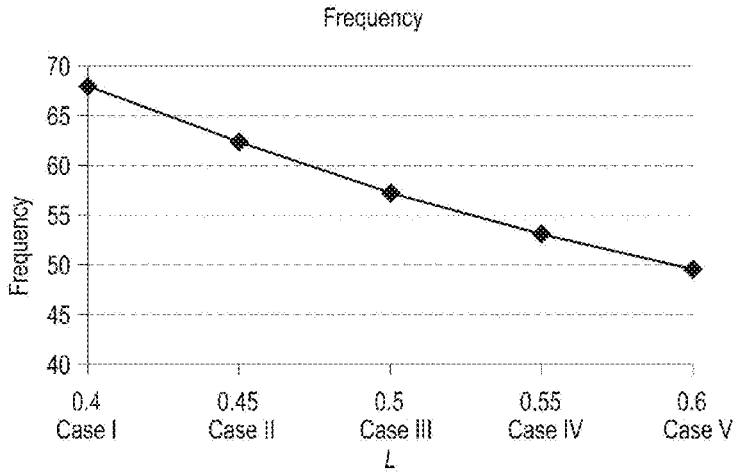
FIG. 6 is a view illustrating a frequency change according to lengths of first and second radiation patches in the antenna device according to the first embodiment among various embodiments of the present disclosure.
Figure 7:
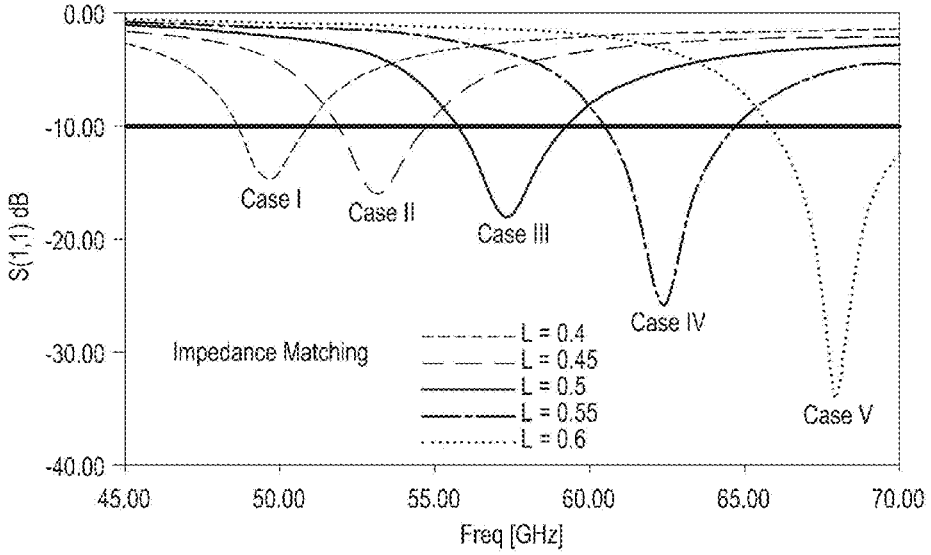
FIG. 7 is a graph illustrating a reflection coefficient (S(1,1)) according to a difference in length between first and second radiation patches in the antenna device according to the first embodiment among various embodiments of the present disclosure.
Figure 8:
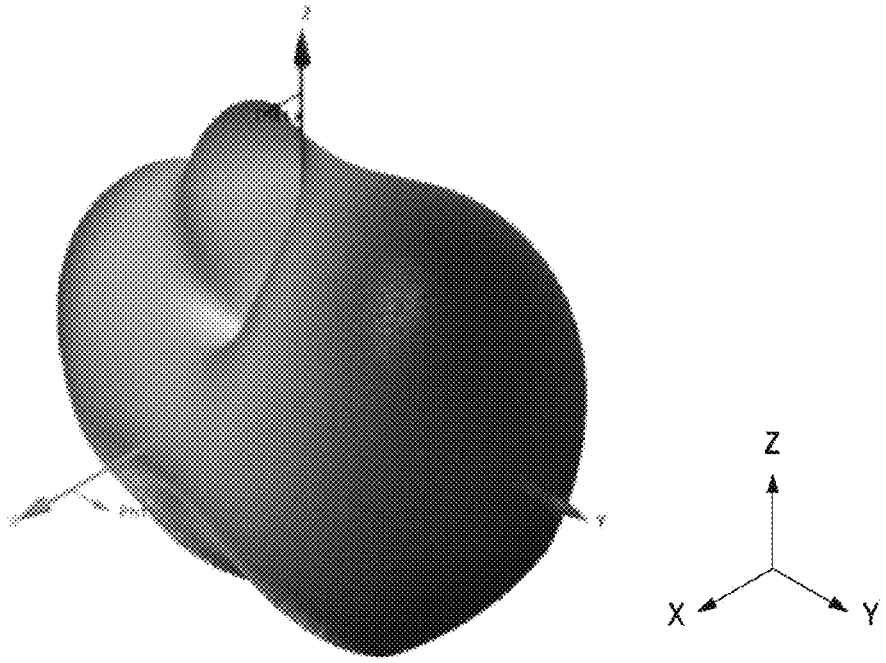
FIG. 8 is a view illustrating a measured radiation characteristic of the antenna device according to the first embodiment among various embodiments of the present disclosure.

FIG. 6 is a view illustrating a frequency change according to lengths of the first radiation patch 221*a* and the second radiation patch 222*a* in the antenna device 100*a* according to the first embodiment among various embodiments of the present disclosure. FIG. 7 is a graph illustrating a reflection coefficient (S(1,1)) according to a difference in length between the first radiation patch 221*a* and the second radiation patch 222*a* in the antenna device 100*a* according to the first embodiment among various embodiments of the present disclosure. FIG. 8 is a view illustrating a measured radiation characteristic of the antenna device 100*a* according to the first embodiment among various embodiments of the present disclosure.

Referring to FIGS. 6 to 8, the frequency of the antenna device 100*a* according to the first embodiment of the present disclosure may be adjusted according to a length L of the first radiation patch 221*a* and the second radiation patch 222*a*. As also described above, the antenna device according to the first embodiment of the present disclosure has an open stub structure so that the length "L" of the first radiation patch 221*a* and the second radiation patch 222*a* may have an electric length of N*(λ/2). Here, N means a natural number and λ means a resonance frequency of the antenna device 100*a*. For example, referring to FIG. 6, assuming that the resonance frequency of an antenna device mounted in an electronic device is in a range of 55 GHz to 60 GHz, the length of the first radiation patch 221*a* and the second radiation patch 222*a*, may properly be 0.5 mm.

In addition, in FIG. 7, "cases 1 to 5" represent reflection coefficients (S(1,1)) of the antenna device 100 when the length L of the second radiator 220 is as follows: L=0.4, L=0.45, L=0.5, L=0.55, and L=0.6, respectively. As illustrated in FIGS. 6 and 7, it may be understood that the resonance frequency of the antenna device 100*a* may be variable according to the length L of the first radiation patch 221*a* and the second radiation patch 222*a*. Thus, according to an operation characteristic required of the electronic device in which the antenna device 100*a* is mounted, the length of the second radiator 220*a* may be selected. In addition, referring to FIG. 8, it can be seen that vertical and horizontal radiation characteristics may appear according to the vertical electric fields generated from the first radiator 230*a* and the second radiator 220*a* and the open stub structure.

Hereinafter, an antenna device 100*b* according to a second embodiment will be described with reference to FIGS. 9 to 12.

Figure 9:
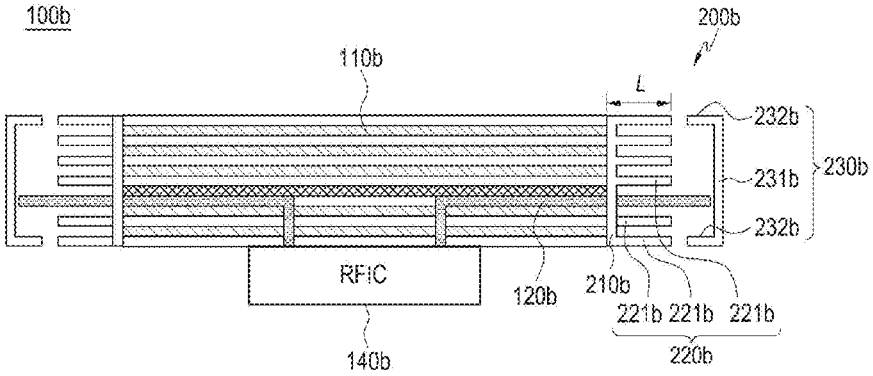
FIG. 9 is a view schematically illustrating an antenna device according to a second embodiment among various embodiments of the present disclosure.
Figure 10:
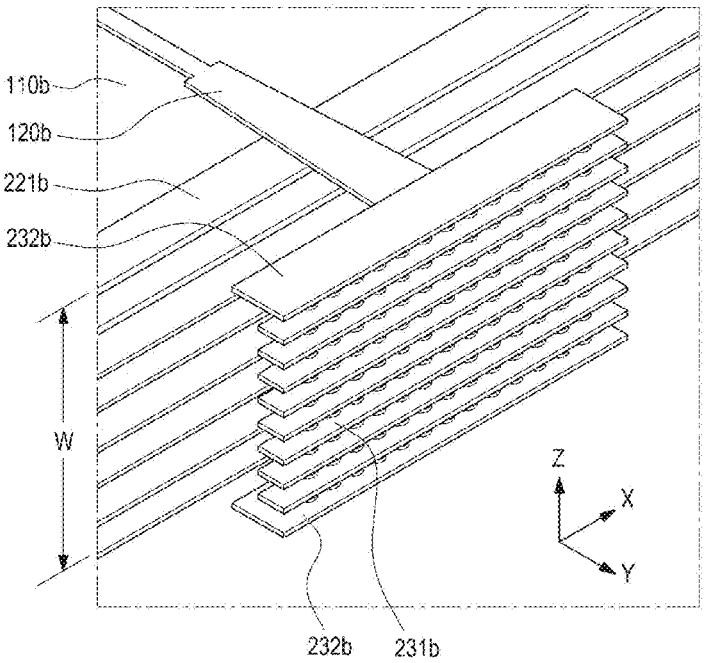
FIG. 10 is a perspective view illustrating a state in which a radiation unit is mounted on a board unit in the antenna device according to the second embodiment among various embodiments of the present disclosure.

FIG. 9 is a view schematically illustrating an antenna device 100*b* according to the second embodiment among various embodiments of the present disclosure. FIG. 10 is a perspective view illustrating a state in which a radiation unit 200*b* is mounted on a board unit 110*b* in the antenna device 100*b* according to the second embodiment among various embodiments of the present disclosure.

The radiation unit 200*b* according to the second embodiment of the present disclosure may include a radiator 230*b* and a ground unit 220*b*. The radiator 230*b* and the ground unit 220*b* are positioned around a peripheral surface of the board unit 110*b*, and the radiator 230*b* according to the second embodiment may be provided to face the peripheral surface of the board unit 110*b* within the width of the board unit 110*b*.

The radiator 230*b* may be spaced apart from the peripheral surface of the board unit 110*b* and to be spaced apart from the ground unit 220*b* provided on the peripheral surface of the board unit 110*b* to be described later. The radiator 230*b* according to the second embodiment of the present disclosure may include a column member 231*b* (hereinafter, referred to as a "radiation column member 231*b*"), and radiation plates 232*b*. The radiation column member 231*b* is spaced apart from the end of the board unit 110*b*, and may be connected with the power feeding unit 120*b*. The maximum size of the radiation column member 231*b* may be the width W of the board unit 110*b* in the width direction, and two radiation plates 232*b* may protrude from the opposite ends of the radiation column member 231*b* toward the board unit 110*b* and face each other. The radiation column member 231*b* may be formed by via holes and via pads that are laminated in the width direction. In addition, the via holes may be electrically connected with and the via pads such that power feeding signals may be transmitted to the radiation plates 232*b* via the power feeding unit 120*b*.

The radiation plates 232*b* protrude from the opposite ends of the radiation column member 231*b* toward the board unit

110*b*. In this way, the radiation plate 232*b* protruding from one end of the radiation column member 231*b* may face the radiation plate 232*b* protruding from the other end of the radiation column member 231*b*. The radiator 230*b* may function to radiate a radiation pattern through the power feeding signals of the power feeding unit 120*b*.

The ground unit 220*b* may be provided on the peripheral surface of the board unit 210 to face the radiator 230*b*. The ground unit 220*b* may have a shape similar to creases formed by laminating a plurality of plates 221*b* along the width direction of the board unit 110*b*.

Figure 11:
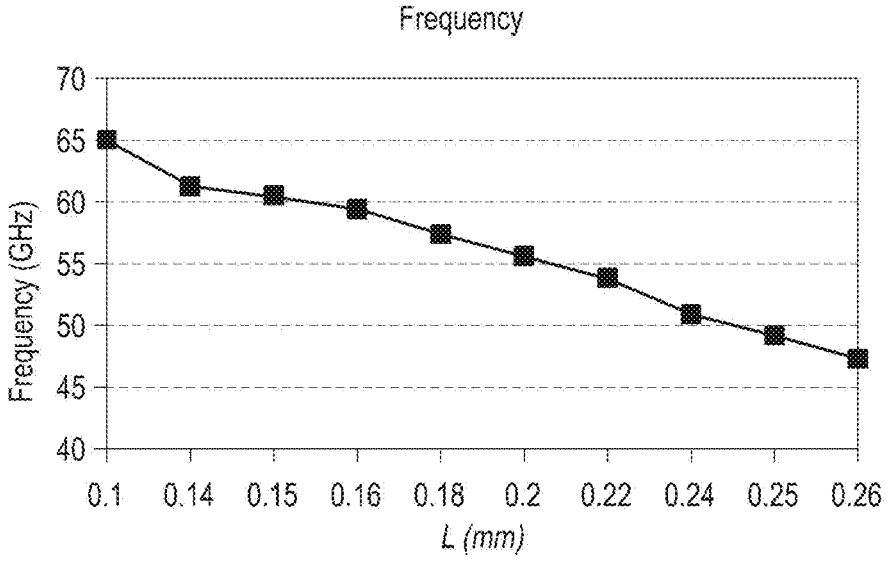
FIG. 11 is a view illustrating a frequency change according to a length of a radiation patch in the antenna device according to the second embodiment among various embodiments of the present disclosure.
Figure 12:
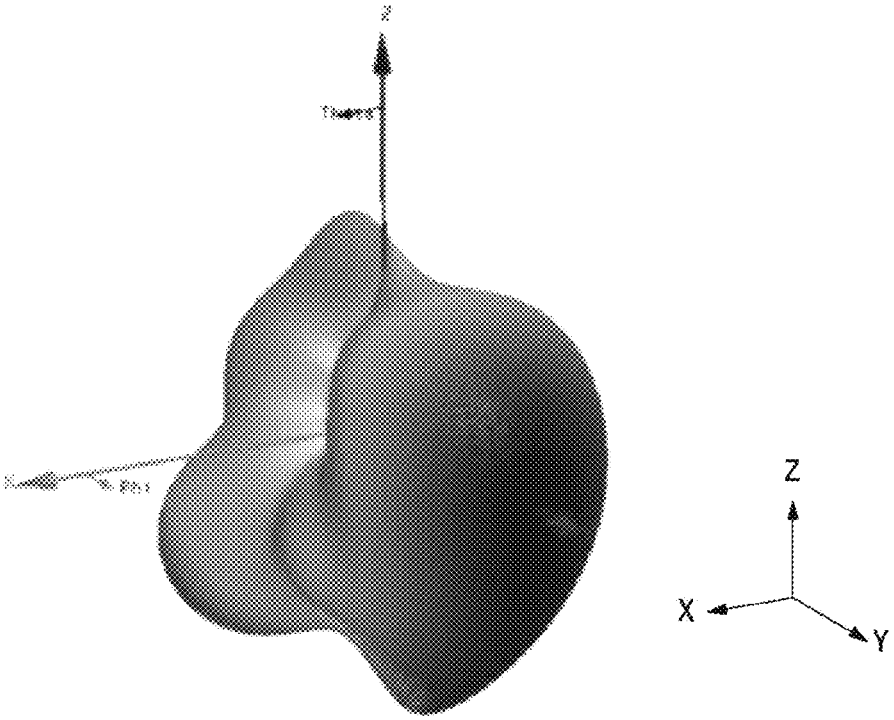
FIG. 12 is a view illustrating a measured radiation characteristic of the antenna device according to the second embodiment among various embodiments of the present disclosure.

FIG. 11 is a view illustrating a frequency change according to a length of a radiation patch in the antenna device 100*b* according to the second embodiment among various embodiments of the present disclosure. FIG. 12 is a view illustrating a measured radiation characteristic of the antenna device 100*b* according to the second embodiment among various embodiments of the present disclosure.

Referring to FIGS. 11 and 12, in the second embodiment of the present disclosure, the ground unit 220*b* is a configuration provided to be capable of reflecting a radiation pattern radiated from the radiator 230*b*, and may have a length L of about twice the entire length of the radiator 230*b*. Since the ground unit 220*b* has a length L of about twice the length of the radiator 230*b*, the radiator 230*b* and the ground unit 220*b* may provide different functions, respectively, in the antenna device 100*b* when a power feeding signal is supplied from the power feeding unit 120*b*. That is, when a power feeding signal is applied in the open stub structure in which the radiator 230*b* faces the ground unit 220*b*, a relatively long portion of the open stub structure may function as the ground unit 220*b*, and the relatively short portion of the open stub structure plays a role as the radiator 230*b*. As a result, the antenna device 100*b* of the second embodiment of the present disclosure may have a resonance frequency that is variable according to the length of the ground unit 220*b*.

In particular, referring to FIG. 11, it can be seen that as the length "L" of the ground unit is reduced, the frequency of the resonance frequency is transformed to a high frequency. That is, since the radiation pattern radiated from the radiator 230*b* is reflected from the ground unit 220*b*, the frequency of the resonance frequency can be determined according to the length "L" of the ground unit. In addition, referring to FIG. 12, the antenna device 100*b* according to the second embodiment of the present disclosure may exhibit radiation characteristics not only in the vertical direction, but also in the horizontal direction. That is, the antenna device 100*b* according to the second embodiment of the present disclosure may generate vertically polarized waves due to the vertical electric field generated between the radiation plates 232*b*, and may exhibit both the horizontal and vertical radiation characteristics due to the open stub structure of the radiator 230*b* and the ground unit 220*b*.

Hereinafter, an antenna device 100*c* according to a third embodiment will be described with reference to FIGS. 13 to 17.

Figure 13:
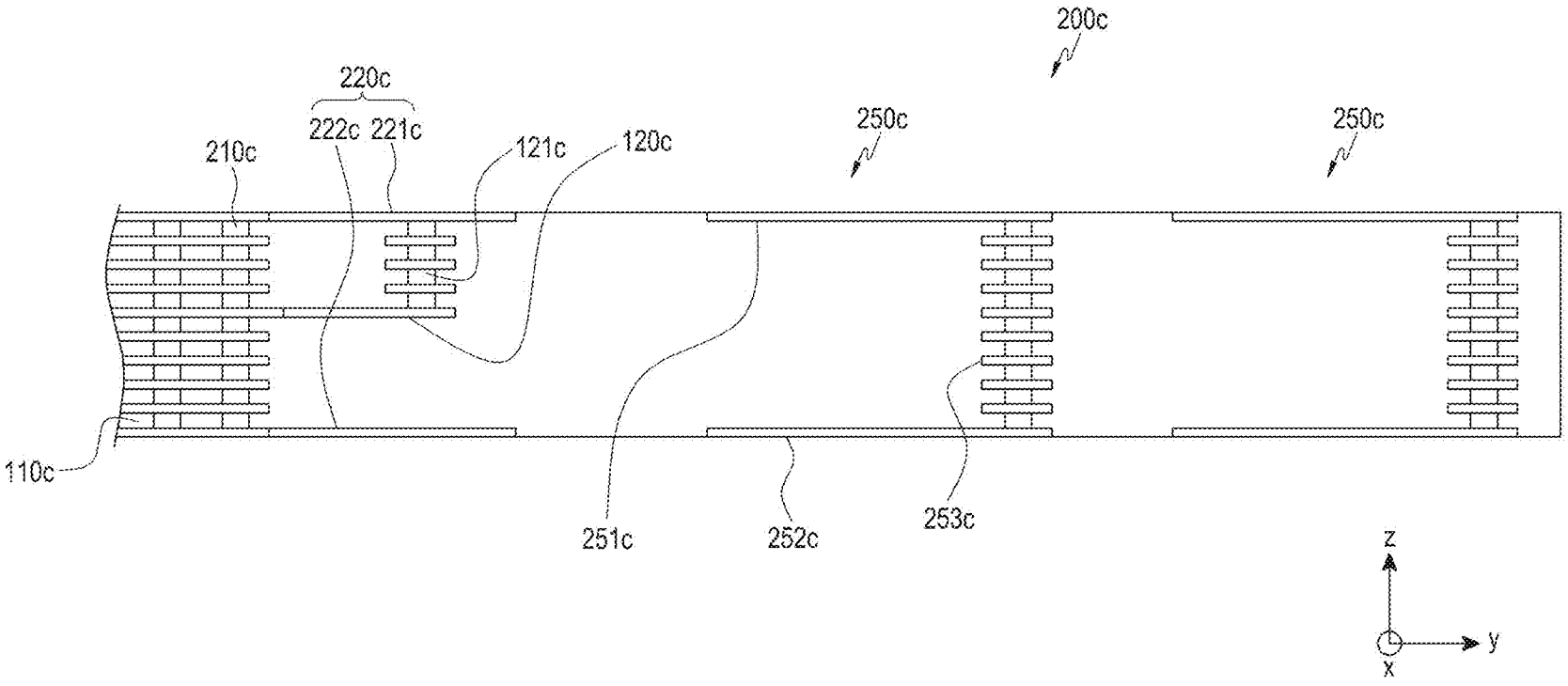
FIG. 13 is a view schematically illustrating an antenna device according to a third embodiment among various embodiments of the present disclosure.
Figure 14:
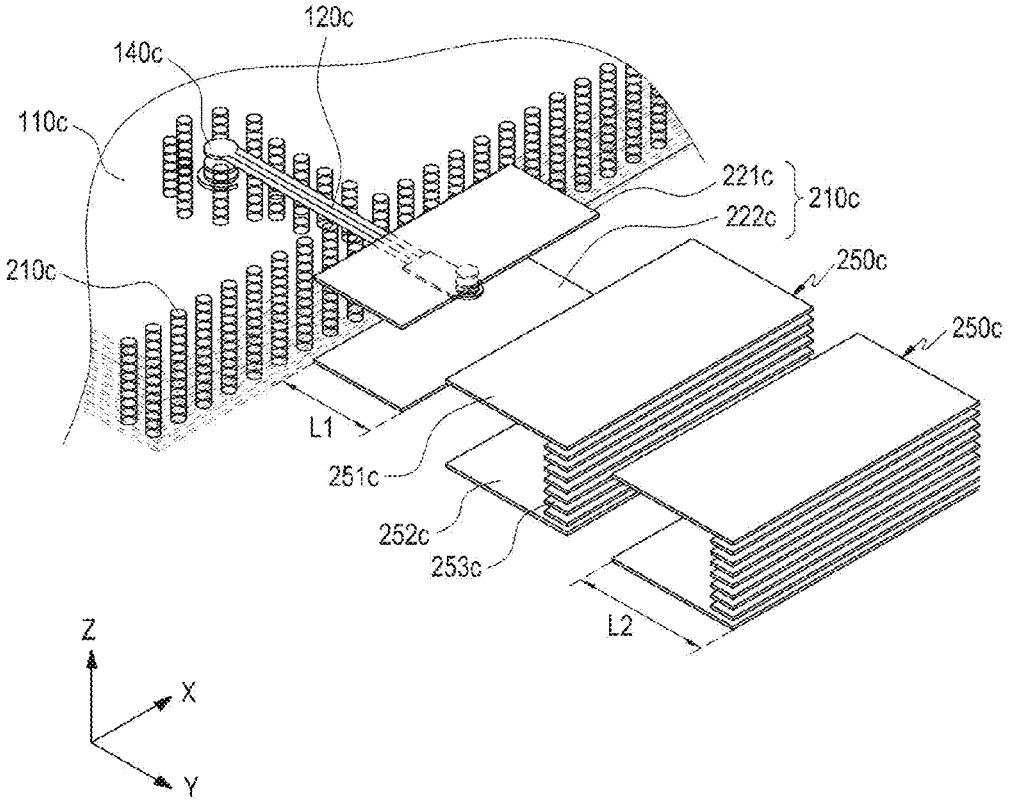
FIG. 14 is a perspective view illustrating a state in which a radiation unit is mounted on a board unit in the antenna device according to the third embodiment among various embodiments of the present disclosure.

FIG. 13 is a view schematically illustrating the antenna device 100*c* according to the third embodiment among various embodiments of the present disclosure. FIG. 14 is a perspective view illustrating a state in which a radiation unit 200*c* is mounted on a board unit 110*c* in the antenna device 100*c* according to the third embodiment among various embodiments of the present disclosure.

Referring to FIGS. 13 and 14, a radiation unit 200*c* according to third embodiment of the present disclosure may implement a radiation pattern in the form of a traveling wave. The radiation unit 200*c* according to the third embodiment of the present disclosure may include radiation members 220*c* and guide radiation members 250*c*.

The radiation members 220*c* are positioned on a peripheral surface of the board unit 110*c*, and may be arranged to face each other with the width of the board unit 110*c* being interposed therebetween.

The radiation members 220*c* may include a first radiator 221*c* and a second radiator 222*c*.

The first radiator 221*c* and the second radiator 222*c* may be arranged to be parallel to each other along the longitudinal direction within the width of the board unit 110*c*. The first radiator 221*c* and the second radiator 222*c* may be connected to the opposite ends of a radiation column member 210*c* provided in a peripheral end of the board unit 110*c*, and may be formed to protrude in the longitudinal direction of the board unit 110*c* to be parallel to each other.

The first radiator 221*c* may be connected with the power feeding unit 120 and may protrude in the longitudinal direction (Y-axis direction) of the board unit 110*c* from the top surface of the board unit 110*c*. The first radiator 221*c* may be formed to protrude in the longitudinal direction of the board unit 110*c* from one end of the radiation column member 210*c* on the top surface of the board unit 110*c*.

The second radiator 222*c* is spaced apart from the first radiator 221*c*, and may be formed to protrude in the longitudinal direction from the other end of the radiation column member 210*c* on the bottom surface of the board unit 110*c*.

The first radiator 221*c* and the second radiator 222*c* described above may form a short stub structure, and both vertically and horizontally polarized waves may be generated due to the vertical electric field generated from the first radiator 221*c* and the second radiator 222*c* and the open stub structure between the first radiator 221*c* and the second radiator 222*c*.

One or more guide radiation members 250*c* may be provided in a direction away from the peripheral surface of the board unit 110*c*. More specifically, the guide radiation members 250*c* may be arranged in a direction away from the radiation member 220*c* in the longitudinal direction (Y-direction). The guide radiation members 250*c* may also be arranged to neighbor the radiation member 220*c* along the longitudinal direction (Y-axis direction). In the third embodiments of the present disclosure, descriptions will be made assuming that two guide radiation members 250*c* are arranged in the longitudinal direction away from the peripheral surface of the board unit 110*c* by way of an example. However, the number of guide radiation members 250*c* is not limited thereto and the mounting number of guide radiation members 250*c* may be freely changed in consideration of, e.g., directivity and an antenna mounting space.

According to an embodiment of the present disclosure, each guide radiation member 250*c* may include a first guide patch 251*c* and a second guide patch 252*c*. The first guide patch 251*c* and second guide patch 252*c* may be adjacent to the first radiator 221*c* and the second radiator 222*c*, align with the first and second radiators 221*c* and 222*c*, or be parallel to each other.

More specifically, each guide radiation member 250*c* may be formed in a "concave" shape toward the board unit 110*c*, more specifically, toward the radiation member 220*c*. The first guide patch 251*c* may be spaced apart or separated from the second guide patch 252*c* by a length or gap in the width direction of the board unit 110*c*. An end of the first guide patch 251*c* may be connected with an end of the second guide patch 252*c* via the column portion 253*c*. The column portion 253*c* is a structure supporting the first guide patch

251*c* and the second guide patch 252*c*. The maximum length of the column portion 253*c* may correspond to the width of the board unit 110*c*.

Figure 15:
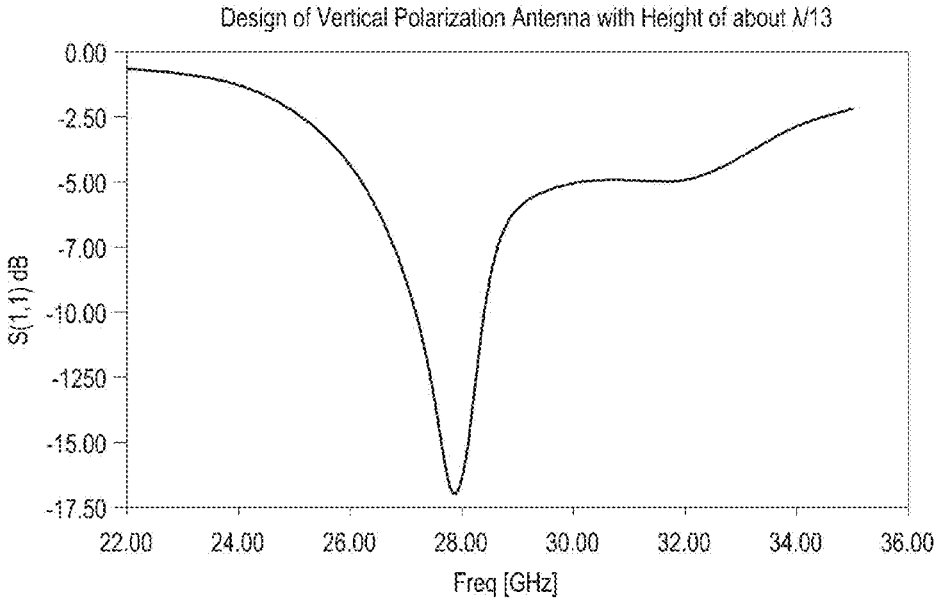
FIG. 15 is a graph illustrating a reflection coefficient (S(1,1)) of the antenna device according to the third embodiment among various embodiments of the present disclosure.
Figure 16:
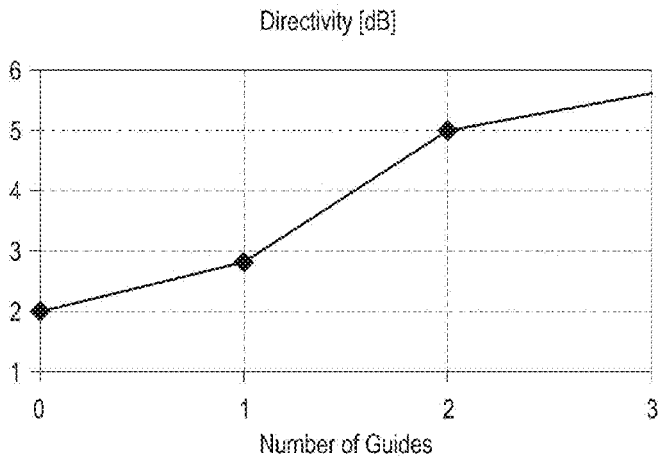
FIG. 16 is a view illustrating a radiation characteristic according to the number of guide radiation members in the antenna device according to the third embodiment among various embodiments of the present disclosure.
Figure 17:
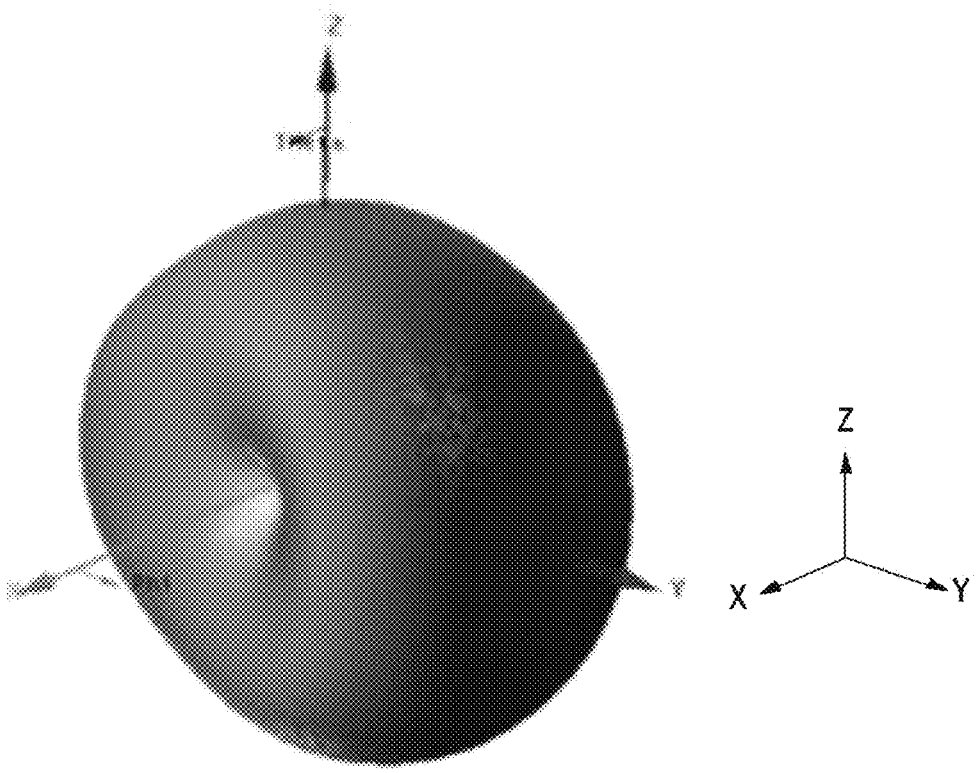
FIG. 17 is a view illustrating a radiation characteristic of the antenna device according to the third embodiment among various embodiments of the present disclosure.

FIG. 15 is a graph illustrating a reflection coefficient (S(1,1)) of the antenna device 100*c* according to the third embodiment among various embodiments of the present disclosure. FIG. 16 is a view illustrating a radiation characteristic according to the number of guide radiation members 250*c* in the antenna device 100*c* according to the third embodiment among various embodiments of the present disclosure. FIG. 17 is a view illustrating a radiation characteristic of the antenna device 100*c* according to the third embodiment among various embodiments of the present disclosure.

Referring to FIGS. 15 to 17, according to an embodiment of the present disclosure, the antenna device 100*c* has a short stub structure, so that the length "L1" of the first radiator 221*c* and the second radiator 222*c*, and the length "L2" of the first guide patch 251*c* and the second guide patch 252*c*, may have an electric length of N*(λ/4). Here, N means a natural number and λ means a resonance frequency of the antenna device 100*c*. Accordingly, the resonance frequency may be adjusted according to the length L1 of the first radiator 221*c* and the second radiator 222*c*, and the length L2 of the first guide patch 251*c* and the second guide patch 252*c*. The length of the first radiator 221*c* and the second radiator 222*c*, and the length of the first guide patch 251*c* and the second guide patch 252*c*, may be selected based on the operating characteristics required of an electronic device including the antenna device 100*c* mounted thereon. As can be seen from FIG. 15, the designed resonance frequency has a reflection coefficient value sharply lowered to about −16 dB in the vicinity of 28 GHz, thus forming a deep valley shape near 28 GHz. That is, at about 28 GHz, the resonance frequency has the lowest reflection loss and a high radiant efficiency to be matched well. Thus, according to an embodiment of the present disclosure, the antenna device 100*c* may be provided with a vertical polarization antenna device having a height of λ/13.

Referring to FIG. 16, the directivity of the antenna device 100*c* increases depending on the mounting number of the guide radiation members 250*c*. That is, the directivity increases as the number of guide radiation members 250*c* increases.

Referring to FIG. 17, it can be seen that the antenna device 100*c* according to the third embodiment of the present disclosure may exhibit radiation characteristics not only in the vertical direction (Z-axis direction) but also in the horizontal direction (Y-axis direction). That is, the antenna device 100*c* according to the third embodiment of the present disclosure may generate a vertical electric field between the first radiator 221*c* and the second radiator 222*c*. Further, the horizontal radiation characteristic may also appear according to the open stub structure between the first radiator 221*c* and the second radiator 222*c*.

Hereinafter, an antenna device 100*d* according to a fourth embodiment will be described with reference to FIGS. 18 to 23.

Figure 18:
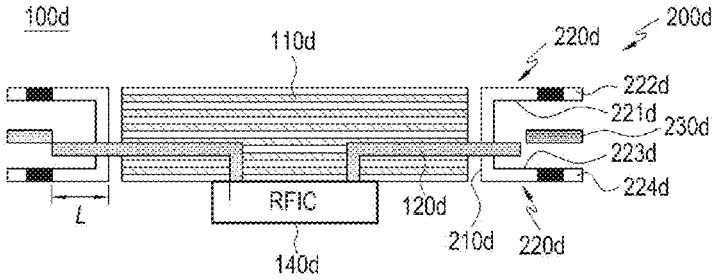
FIG. 18 is a view schematically illustrating an antenna device according to a fourth embodiment among various embodiments of the present disclosure.
Figure 19:
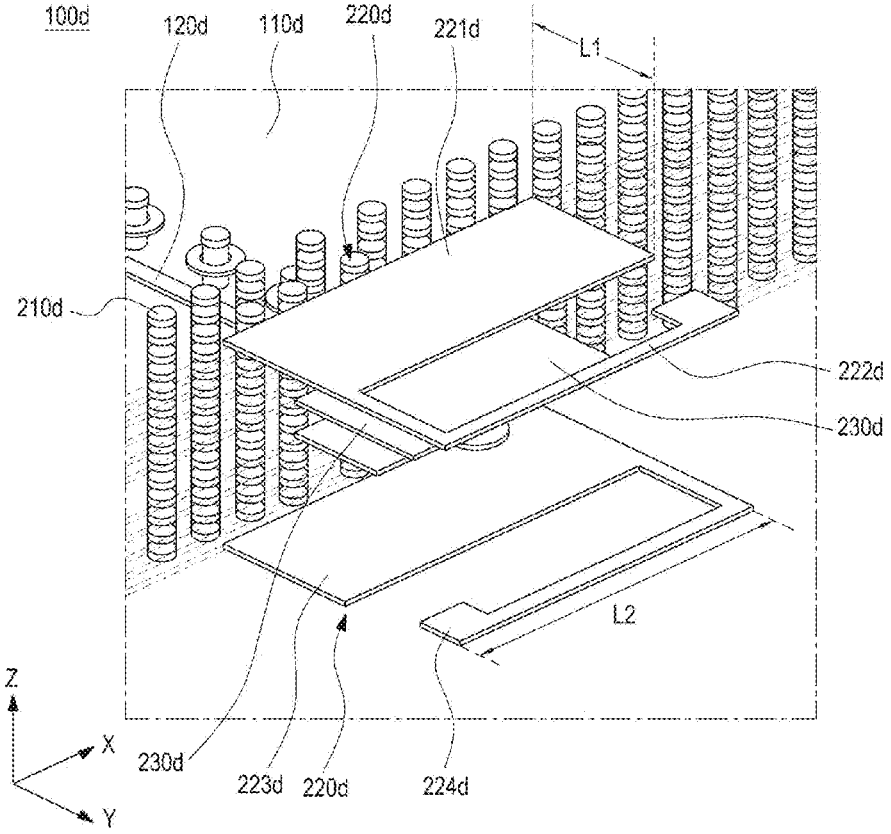
FIG. 19 is a perspective view illustrating a state in which a radiation unit is mounted on a board unit in the antenna device according to the fourth embodiment among various embodiments of the present disclosure.

FIG. 18 is a view schematically illustrating an antenna device 100*d* according to a fourth embodiment among various embodiments of the present disclosure. FIG. 19 is a perspective view illustrating a state in which a radiation unit 200*d* is mounted on a board unit 110*d* in the antenna device 100*d* according to the fourth embodiment among various embodiments of the present disclosure.

Referring to FIGS. 18 and 19, the antenna device 100*d* according to the fourth embodiment of the present disclosure is capable of implementing a radiation pattern of a wideband circular polarization antenna.

According to the fourth embodiment of the present disclosure, a radiation unit 200*d* may be arranged within the width of the board unit 110*d* along the periphery of the board unit 110*d*. The radiation unit 200*d* according to the fourth embodiment may include a first radiator 230*d* and a second radiator 220*d*. The first radiator 230*d* and the second radiator 220*d* are positioned on the peripheral surface of the board unit 110*d* and may be arranged to face each other within the width of the board unit 110*d*. In addition, the first radiator 230*d* and the second radiator 220*d* according to the fourth embodiment of the present disclosure may generate an electric field in a direction (X-axis direction) parallel to peripheral surfaces of the board unit 110*d*, and an electric field in a direction (Z-axis direction) perpendicular to the board unit 110*d*. As a result, the first radiator 230*d* and the second radiator 220*d* may generate a polarization radiation pattern parallel to the peripheral surface of the board unit 110*d*, and a polarization radiation pattern vertical to the peripheral surface of the board unit 110*d*.

More specifically, the first radiator 230*d* may be provided as a radiation patch 230*d* connected with a power feeding unit 120*d*, and protrude in the longitudinal direction (Y-axis direction) of the board unit 110*d*. The radiation patch 230*d* may be arranged between the top surface and the bottom surface of the board unit 110*d*, and may be arranged between the second radiators 220*d* to be described later, more specifically between first radiation patches 221*d*, 222*d* and second radiation patches 223*d* and 224*d*.

The second radiators 220*d* may be spaced apart from the radiation patch 230*d* and to face the radiation patch 230*d*, and may be parallel to the radiation patch 230*d* above and below the radiation patch 230*d*. More specifically, the second radiators 220*d* may be arranged on the top surface and a bottom surface of the board unit 110*d*. The top surface may be spaced apart from the bottom surface by a width of the board unit 110*d*, and protrude in parallel in the longitudinal direction (Y-axis direction) of the board unit 110*d*. The second radiators 220*d* may include the first radiation patch 221*d*, 222*d* and second radiation patch 223*d* and 224*d*, thus generating radiation patterns having horizontal polarized waves and vertically polarized waves.

The first radiation patch 221*d*, 222*d* may be formed to protrude in the longitudinal direction from the top surface of the board unit 110*d*, and may be spaced apart from the top surface of the first radiator.

The first radiation patch 221*d*, 222*d* may include a first vertical polarization radiation portion 221*d*, and a first horizontal polarization radiation portion 222*d*. The first vertical polarization radiation portion 221*d* may protrude in the longitudinal direction (Y-axis direction) of the board unit 110*d* while having a predetermined area in the periphery of the top surface of the board unit 110*d*. The first horizontal polarization radiation portion 222*d* may extend from an end of the first vertical polarization radiation portion 221*d* and may be curved in a "convex" shape. That is, the first horizontal polarization radiation portion 222*d* may extend from an end of the first vertical polarization radiation portion 221*d* and bent in a direction parallel to the peripheral surface of the board unit 110*d* to be spaced apart from the end of the first vertical polarization radiation portion 222*d*. As the first horizontal polarization radiation portion 222*d* is provided at the end of the first vertical polarization radiation portion 221*d* in an "L" shape, the first horizontal polarization radiation portion 222*d* may be formed as if the end of the first vertical polarization radiation portion 221*d* is cut.

The second radiation patch 223*d*, 224*d* may include a second vertical polarization radiation portion 223*d*, and a second horizontal polarization radiation portion 224*d*. The second vertical polarization radiation portion 223*d* may protrude in the longitudinal direction (Y-axis direction) of the board unit 110*d* while having a predetermined area around the bottom surface of the board unit 110*d*. The second horizontal polarization radiation portion 224*d* may be formed to extend from the end of the second vertical polarization radiation portion 223*d* and bent in a "concave" shape. The second horizontal polarization radiation portion 224*d* may be separated from the first horizontal polarization radiation portion 222*d* in the direction opposite to the first horizontal polarization radiation portion 222*d*. That is, the second horizontal polarization radiation portion 224*d* may extend from another end of the second vertical polarization radiation portion 223*d*, and be bent in the direction parallel to the peripheral surface of the board unit 110*d* to be spaced apart from the end of the second vertical polarization radiation unit 223*d*. As the second horizontal polarization radiation portion 224*d* is provided in a "]" (mirror image of an "L") shape at the end of the second vertical polarization radiation portion 223*d*, the second horizontal polarization radiation portion 224*d* is formed as if the end of the second vertical polarization radiation portion 223*d* is cut.

Figure 20A:
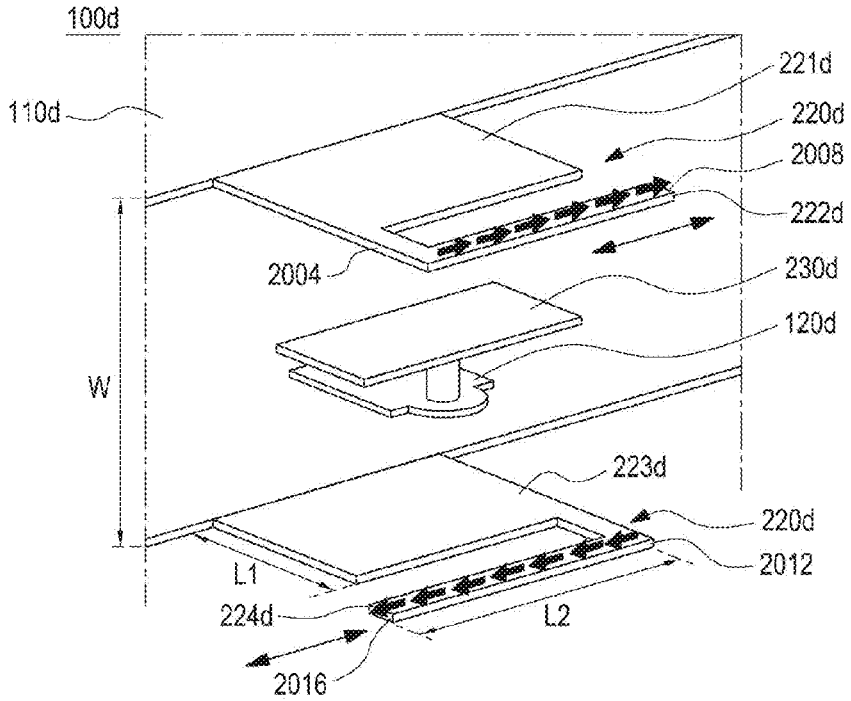
FIGS. 20A and 20B are views illustrating electric fields of a vertical polarization radiation pattern and a horizontal polarization radiation pattern generated in first and second radiation patches of the antenna device according to the fourth embodiment among various embodiments of the present disclosure.
Figure 20B:
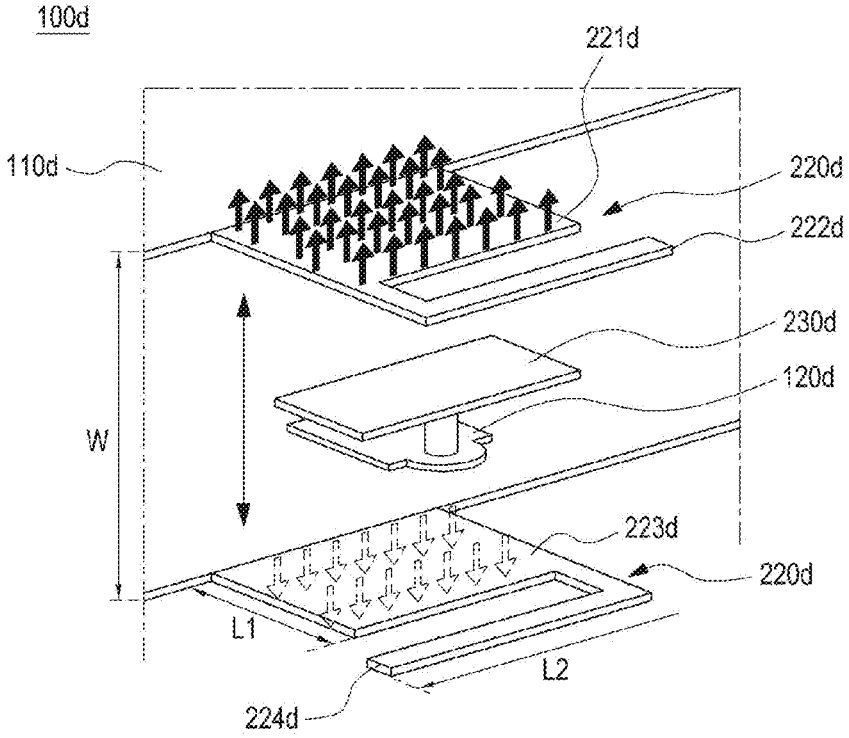

FIGS. 20A and 20B are views illustrating electric fields of a vertical polarization radiation pattern and a horizontal polarization radiation pattern generated in first and second radiation patches of the antenna device 100*d* according to the fourth embodiment among various embodiments of the present disclosure.

Referring to FIGS. 20A and 20B, when a power feeding signal is applied to the first radiator 230*d* and the second radiators 220*d* through the power feeding unit 120, electric fields may be generated in the vertical direction between the first radiator 230*d* and the second radiators 220*d* and in the direction parallel to the peripheral surface of the board unit 110*d*. More specifically, the first horizontal polarization radiation portion 222*d* may generate a horizontal electric field in a direction from one side 2004 to an opposite side 2008 (with reference to FIG. 20A, in the direction from the left to the right). In addition, the second horizontal polarization radiation portion 224*d* may generate a horizontal electric field in a direction from one side 2012 to an opposite side 2016 (with reference to FIG. 20A, in the direction from the right to the left).

In addition, each of the first vertical polarization radiation portion 221*d* and the second vertical polarization radiation portion 223*d* may generate a vertical electric field. As a result, as the electric fields perpendicular to both the first radiation patch 221*d*, 222*d* and the second radiation patch 223*d*, 224*d* are generated, and as the electric fields parallel to the peripheral surface of the board unit 110*d* are generated, a radiation pattern of a wideband circular polarization antenna may be implemented.

Figure 21:
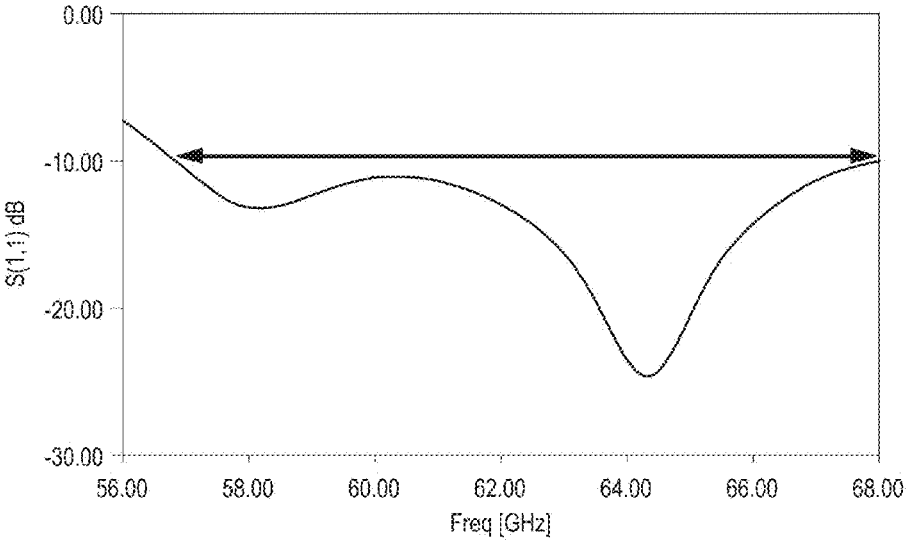
FIG. 21 is a graph illustrating a reflection coefficient (S(1,1)) of the antenna device according to the fourth embodiment among various embodiments of the present disclosure.
Figure 22:
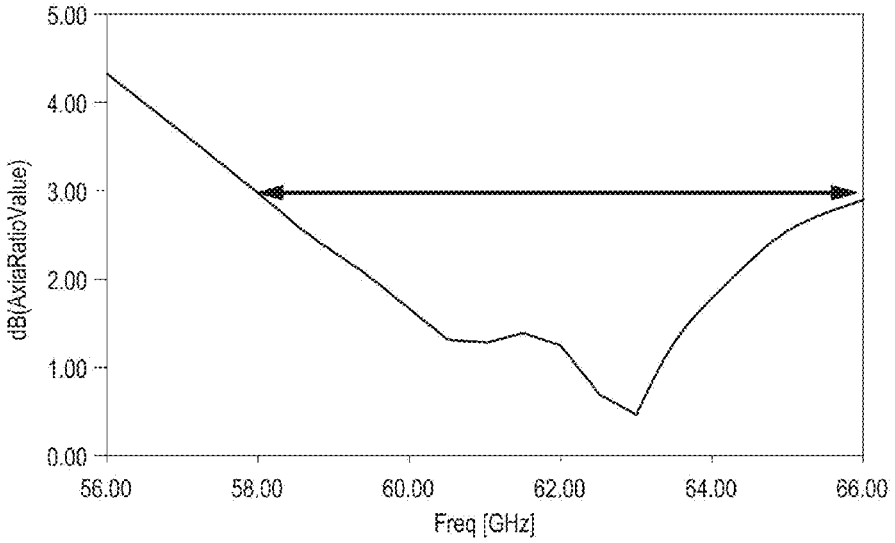
FIG. 22 is a graph illustrating a frequency band capable of being secured by first and second radiation patches in the antenna device according to the fourth embodiment among various embodiments of the present disclosure.
Figure 23:
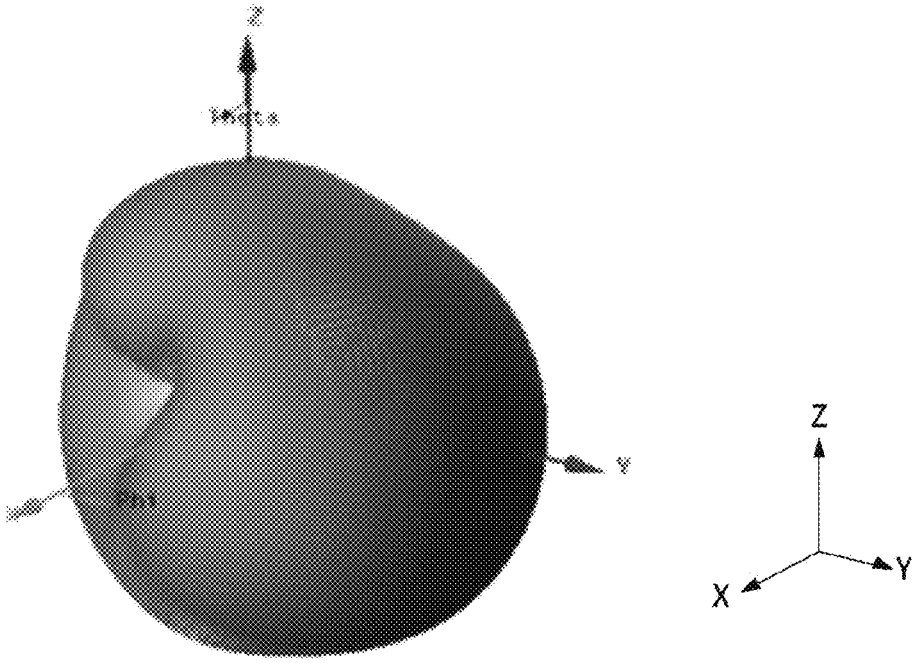
FIG. 23 is a view illustrating a measured radiation characteristic of the antenna device according to the fourth embodiment among various embodiments of the present disclosure.

FIG. 21 is a graph illustrating a reflection coefficient (S(1,1)) of the antenna device 100*d* according to the fourth embodiment among various embodiments of the present disclosure. FIG. 22 is a graph illustrating a frequency band capable of being secured by first and second radiation patches in the antenna device 100*d* according to the fourth embodiment among various embodiments of the present disclosure. FIG. 23 is a view illustrating a measured radiation characteristic of the antenna device 100*d* according to the fourth embodiment among various embodiments of the present disclosure.

Referring to FIGS. 21 to 23, when the resonance frequency of the antenna device 100*d* is within a range of about 57 GHz to about 68 GHz, the reflection coefficient has a value of −10 dB or less. In addition, within the range of the resonance frequency, the axial ratio value may have a value of 3 dB or less. That is, with reference to a single power feeding, the highest band width can be secured with respect to the area of the first and second radiation patches.

Accordingly, referring to FIG. 23, like the antenna device 100*d* of the fourth embodiment of the present disclosure, a vertical electric field and an electric field orthogonal thereto are both generated through the first radiation patch 221*d*, 222*d* and the second radiation patch 223*d*, 224*d* so that a wideband circular polarization radiation pattern can be implemented, and such a radiation characteristic may appear.

Hereinafter, an antenna device 100*e* according to a fifth embodiment will be described with reference to FIGS. 24 to 30.

Figure 24:
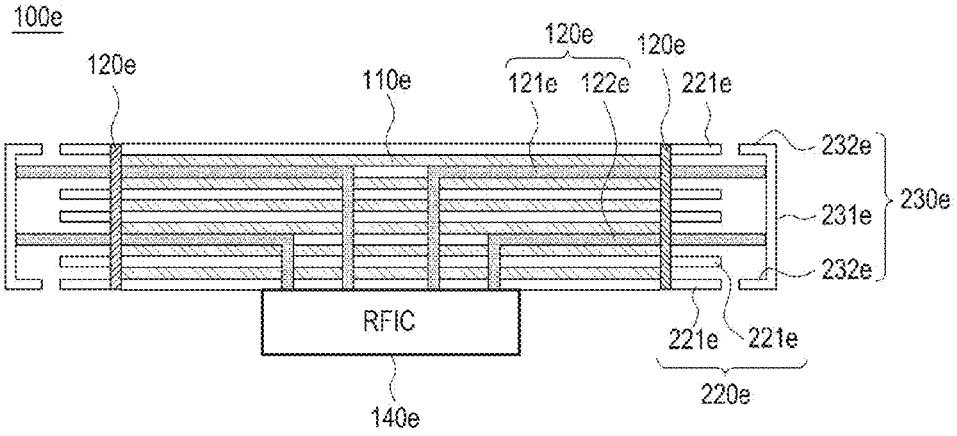
FIG. 24 is a view schematically illustrating an antenna device according to a fifth embodiment among various embodiments of the present disclosure.
Figure 25:
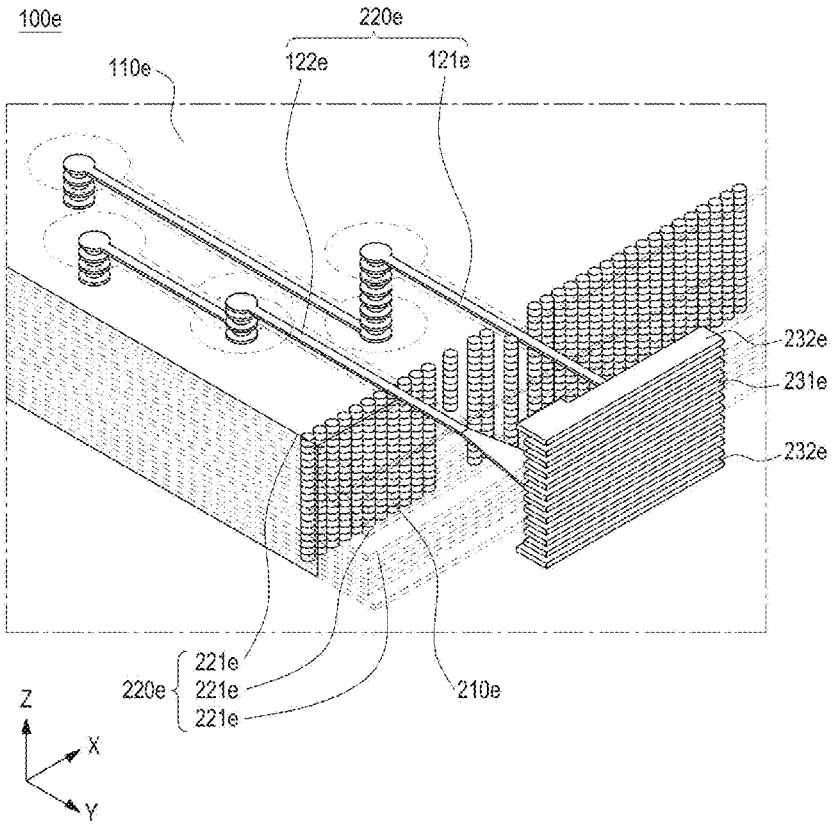
FIG. 25 is a perspective view illustrating a state in which a radiation unit is mounted on a board unit in the antenna device according to the fifth embodiment among various embodiments of the present disclosure.

FIG. 24 is a view schematically illustrating an antenna device 100*e* according to a fifth embodiment among various embodiments of the present disclosure. FIG. 25 is a perspective view illustrating a state in which a radiation unit 200*e* is mounted on a board unit 110*e* in the antenna device 100*e* according to the fifth embodiment among various embodiments of the present disclosure.

Referring to FIGS. 24 and 25, the radiation unit 200*e* of the antenna device 100*e* according to the fifth embodiment of the present disclosure is positioned on a peripheral surface of the board unit 110*e*, and may include a radiator 230*e* and a ground unit 220*e* that are provided to face the peripheral surface of the board unit 110*e* and to face each other within the width of the board unit 110*e*.

The antenna device 100*e* according to the fifth embodiment of the present disclosure has a structure similar to that of the antenna device 100*b* according to the second embodiment described above, but is different from the antenna device 100*b* according to the second embodiment in terms of the configuration of the power feeding unit 120*e*.

More specifically, according to the fifth embodiment of the present disclosure, the radiation unit 200*e* may include a radiator 230*e* and a ground unit 220*e*. The radiator 230*e* and the ground unit 220*e* may be positioned on the peripheral surface of the board unit 110*e*, and the radiator 230*e* according to the fifth embodiment of the present disclosure may be provided to face the peripheral surface of the board unit 110*e* within the width W of the board unit 110*e*.

The radiator 230*e* may be spaced apart from the peripheral surface of the board unit 110*e* so that the radiator 230*e* may be spaced apart from the ground unit 220*e* provided on the peripheral surface of the board unit 110*e*. The radiator 230*e* may include a radiation column member 231*e* disposed within the width of the board unit 110*e*, as well as radiation plates 232*e* protruding or extending toward the board unit 110*e* from the opposite ends of the radiation column member. As a result, the radiator 230*e* may be formed in a "concave" shape.

The radiation column member 231*e* may be formed by via holes and via pads laminated in the width direction. In addition, the via holes may be electrically connected with the via pads such that a power feeding signal may be transferred to the radiation plates 232*e* through the power feeding unit 120*e*.

The radiation plates 232*e* are provided to protrude or extend toward the board unit 110*e* from the opposite ends of the radiation column member 231*e* so that the radiation plate 232*e* protruding or extending from one end of the radiation column member 231*e* may face the radiation plate 232*e* protruding or extending from the other end of the radiation column member 231*e*. The radiator 230*e* may radiate various forms of radiation patterns through power feeding signals of the power feeding unit 120*e* to be described later. The radiator 230*e* according to the fifth embodiment of the present disclosure is electrically connected with two different power feeding lines that provide power feeding signals of different polarized waves. Thus, the radiator 230*e* may be provided to generate a horizontal polarization radiation pattern (X-axis direction), a vertical polarization radiation pattern (Z-axis direction), and a diagonal polarization radiation pattern or a circular polarization radiation pattern according to the application of power feeding signals.

The ground unit 220*e* may be provided on the peripheral surface of the board unit 210 to face the radiator 230*e*. The ground unit 220*e* may be formed in a shape similar to creases formed by laminating a plurality of plates 221*e* in the width direction of the board unit 110*e*.

As described above, according to the fifth embodiment of the present disclosure, the power feeding unit 120*e* may include a first power feeding line 121*e* connected to the radiator 230*e* to provide a horizontal polarization power feeding signal between the first radiator 230*e* and the second radiator 220*e*, and a second power feeding line 122*e* connected to the first radiator 230*e* to provide vertical polarization power feeding signals between the first radiator 230*e* and the second radiator 220*e*. The first power feeding line 121*e* and the second power feeding line 122*e* may be selectively turned ON/OFF.

Figures 26, 27:
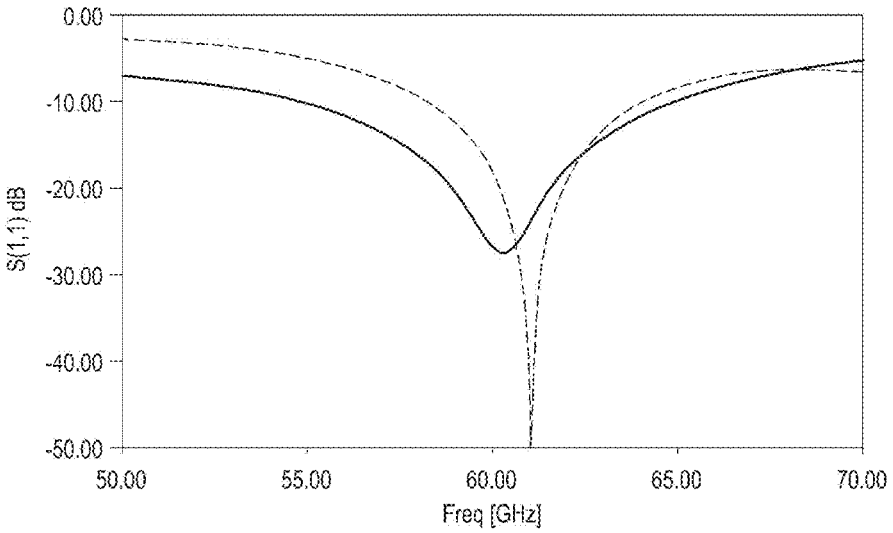
FIG. 26 is a table illustrating radiation patterns according to selective ON/OFF of first and second power feeding lines in the antenna device according to the fifth embodiment among various embodiments of the present disclosure.
FIG. 27 is a graph illustrating a measured reflection coefficient (S(1,1)) of the antenna device according to the fifth embodiment among various embodiments of the present disclosure.

FIG. 26 is a table illustrating radiation patterns according to selective ON/OFF of the first and second power feeding lines in the antenna device 100*e* according to the fifth embodiment among various embodiments of the present disclosure.

Referring to FIG. 26, when the first power feeding line 121*e* is turned ON and the second power feeding line 122*e* turned OFF so that power feeding signals flow into the radiation unit 200*e* from the first power feeding line 121*e*, the radiation unit 200*e* may generate a horizontal polarization radiation pattern (in the direction parallel to the peripheral surface of the board unit 110*e*). When the first power feeding line 121*e* is turned OFF and the second power feeding line 122*e* is turned ON so that power feeding signals flow into the radiation unit 200*e* from the second power feeding line 122*e*, the radiation unit 200*e* may generate a vertical polarization radiation pattern. When both the first power feeding line 121*e* and the second power feeding lines the 122*e* are turned ON so that power feeding signals flow into the radiation unit 200*e* from the first and second power feeding lines 121*e* and 122*e*, the radiation unit 200*e* may generate a diagonal polarization radiation pattern. When both the first power feeding line 121*e* and the second power feeding lines the 122*e* are turned ON, power feeding signals flow into the radiation unit 200*e* from the both the first power feeding line 121*e* and the second power feeding lines the 122*e*. When the power feeding signals flow from the both the first power feeding line 121*e* and the second power feeding lines the 122*e* into the radiation unit 200*e* at 90 degree intervals, the radiation unit 200*e* may generate a circular polarization radiation pattern.

Figures 28A, 28B:
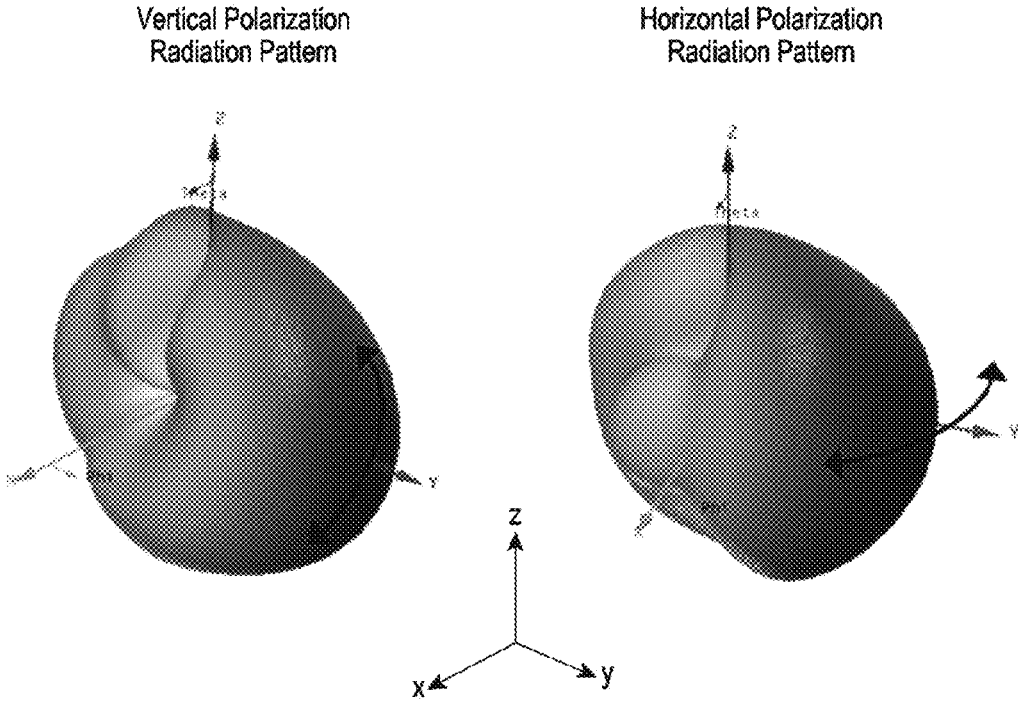
FIGS. 28A and 28B are views illustrating a radiation characteristic of the antenna device according to fifth embodiment among various embodiments of the present disclosure.

FIG. 27 is a graph illustrating a reflection coefficient (S(1,1)) of the antenna device 100*e* according to the fifth embodiment among various embodiments of the present disclosure. FIGS. 28A and 28B are views illustrating a radiation characteristic of the antenna device 100*e* according to fifth embodiment among various embodiments of the present disclosure Referring to FIG. 27 and FIGS. 28A and 28B, when the first power feeding line 121*e* and the second power feeding line 122*e* of the present disclosure are selectively driven so that power feeding signals are applied to the radiation unit 200*e*, the horizontal polarization radiation pattern (X-axis direction) may have a reflection coefficient of about 61 GHz, and the vertical polarization wave radiation pattern (Z-axis direction) may have a reflection coefficient of about 60 GHz.

In addition, when power feeding signals are applied to the radiation unit 200*e* only from the first power feeding line 121*e*, a polarization radiation characteristic in the horizontal direction (X-axis direction) may appear as illustrated in FIG. 28B. That is, a horizontal (X-axis direction) electric field may be generated between the radiator 230*e* and the ground unit 220*e*, and both a horizontal radiation characteristic in the X-axis direction and a horizontal radiation characteristic in the Y-axis direction may be generated due to the open stub structure of the radiator 230*e* and the ground unit 220*e*.

In addition, when power feeding signals are applied to the radiation unit 200*e* only from the second power feeding line 122*e*, it can be seen that a polarization radiation characteristic in the vertical direction (Z-axis direction) may appear as illustrated in FIG. 28A. That is, a vertical (Z-axis direction) electric field may be generated between the radiator 230*e* and the ground unit 220*e*, and both a vertical radiation characteristic in the Z-axis direction and a horizontal radiation characteristic in the Y-axis direction may appear according to the open stub structure of the radiator 230*e* and the ground unit 220*e*.

Figure 29A:
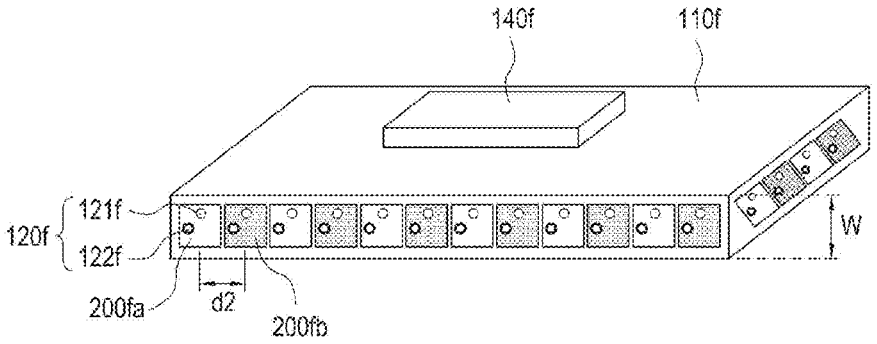
FIGS. 29A to 29C are views illustrating a case in which the antenna device according to the fifth embodiment among various embodiments of the present disclosure is provided with radiation units having two different frequency bands.
Figure 29B:
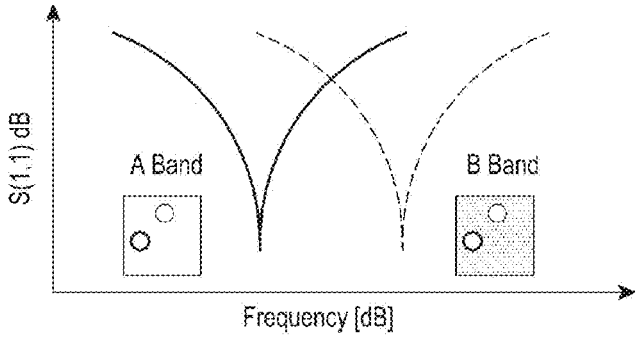
Figure 29C:
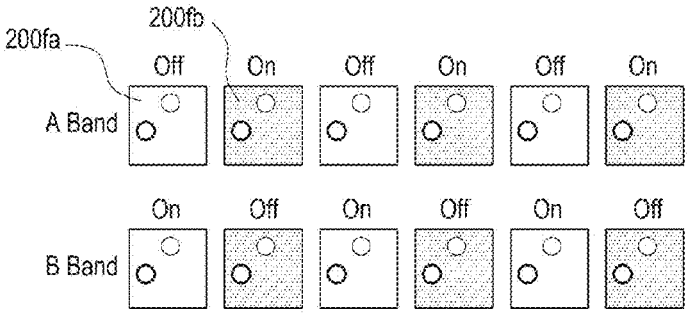

FIGS. 29A to 29C are views illustrating a case in which the antenna device 100*f* according to the fifth embodiment among various embodiments of the present disclosure is provided with radiation units 200 having two different frequency bands.

Referring to FIGS. 29A to 29C, a plurality of antenna devices 100*f* according to the fifth embodiment of the present disclosure may be arranged along the peripheral surface of the board unit 110*f*. In addition, the antenna devices 100*f* according to the fifth embodiment of the present disclosure may be arranged such that an antenna device 100*f* and a neighboring antenna are closely arranged to each other.

More specifically, the radiation unit 200 according to the fifth embodiment of the present disclosure may include a first radiation unit 200*fa* and a second radiation unit 200*fb* closely arranged to the first radiation unit 200*fa*.

A plurality of first radiation units 200*fa* may be spaced apart from each other along the peripheral surface of the board unit 110*f*. A second radiation unit 200*fb* may be arranged between each two adjacent first radiation units 200*fa*. The first radiation units 200*fa* may transmit and/or receive signals in a frequency band (hereinafter, referred to as a "first frequency band") different from that of the second radiation units.

A plurality of second radiation units 200*fb* may be spaced apart from each other along the peripheral surface of the board unit 110*f*. A first radiation unit 200*fa* may be arranged between each two adjacent second radiation units 200*fb*. The second radiation units 200*fb* may transmit and/or receive signals in a frequency band (hereinafter, referred to as a "second frequency band") that is different from that of the first radiation units.

Since the first radiation units 200*fa* according to the fifth embodiment of the present disclosure are have the first frequency band, it is desirable to arrange the first radiation units 200*fa* to be spaced apart from each other in order to prevent interference therebetween. However, since the second radiation units 200*fb* transmits/receives the second frequency band that is different from the frequency band of the first radiation units 200*fa*, the second radiation units 200*fa* may be prevented from interfering with the first radiation units 200*fa*. Thus, the first radiation units 200*fa* and the second radiation units 200*fb* may be arranged close to each other. The first radiation units 200*fa* and the second radiation units 200*fb* may be provided to be selectively turned ON/OFF depending on the transmission/reception of the first frequency band or the second frequency band.

Accordingly, when signal in the first frequency band is transmitted or received, the first radiation units 200*fa* may be driven. On the contrary, when the second frequency band is transmitted or received, the second radiation units 200*fb* may be driven. As the first and second radiation units 200*fa* and 200*fb* have different frequency bands as described above, the first and second radiation units 200*fa* and 200*fb* are closely arranged along the peripheral surface of the board unit 110*f* so that the space can be efficiently used and the antenna radiation performance can be improved.

Figure 30A:
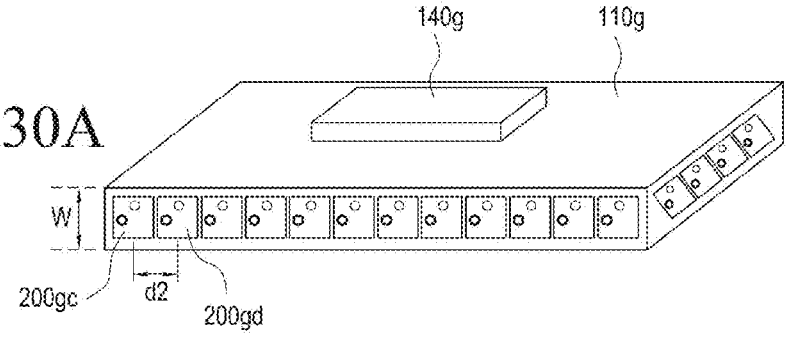
FIGS. 30A to 30E are views illustrating a case in which the antenna device according to the fifth embodiment among various embodiments of the present disclosure is provided with two radiation units as transmission and reception patterns.
Figure 30B:
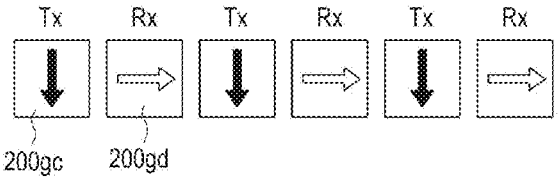

FIGS. 30A and 30B are views illustrating a case in which the antenna device 100*g* according to the fifth embodiment among various embodiments of the present disclosure is provided with two radiation units 200 as transmission and reception patterns.

Figure 30C:
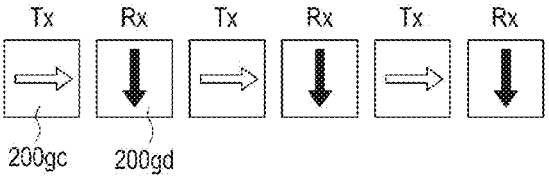
Figure 30D:
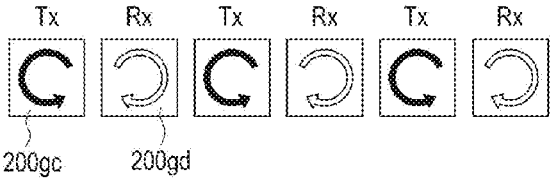
Figure 30E:
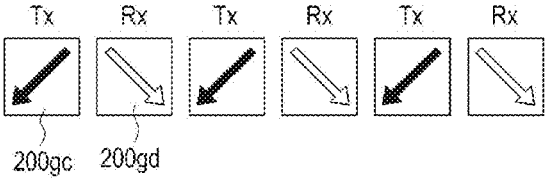

Referring to FIGS. 30A and 30B, the radiation unit illustrated in FIGS. 30A to 30E has a structure similar to that of the radiation unit 200 described above with reference to FIGS. 29A to 29C. However, while the radiation unit 200 described above is configured such that the first radiation units 200*a* may transmit and receive the first frequency band, and the second radiation units 200*b* may transmit and receive the second frequency band which is not interfered with the first frequency band, the first radiation unit 200*gc* and the second radiation units 200*gd* in FIGS. 30A to 30C are configured such that the first radiation units 200*gc* are driven for transmission or reception of a specific frequency, and the second radiation units 200*gd* are driven for reception or transmission.

More specifically, according to an embodiment of the present disclosure, the radiation unit 200 may include the first radiation units 200*gc* arranged along a periphery of the board unit 110*g* and spaced apart from each other. The radiation unit 200 may also include the second radiation units 200*gd* arranged along the periphery of the board unit 110*g* and spaced apart from each other in which a second radiation unit 200*gd* is arranged between each two adjacent first radiation units 200*gc*. Thus, one of the first and second radiation units may be driven as a transmission antenna, while the other of the first and second radiation units may be driven as a reception antenna.

For example, when the first radiation units 200*gc* are driven as transmission antennas as illustrated in FIG. 30B, the second radiation units 200*gd* may be driven as reception antennas. In addition, when the first radiation units 200*gc* are driven as reception antennas as illustrated in FIG. 30C, the second radiation units 200*gd* may be driven as transmission antennas.

In addition, when the first and second radiation units 200*gc* and 200*gd* are driven as transmission antennas and reception antennas, respectively, the first and second radiation units 200*gc* and 200*gd* may be configured to transmit or receive frequency bands having radiation patterns of different electric fields. That is, the first radiation units 200*gc* may transmit or receive at least one of a vertical polarization radiation pattern, a horizontal polarization radiation pattern, a diagonal polarization radiation pattern, and a circular polarization radiation pattern, and the second radiation units 200*gd* may be configured to transmit/receive the frequency pattern different from that of the first radiation unit 200*gc* among the vertical polarization radiation pattern, the horizontal polarization radiation pattern, the diagonal polarization radiation pattern and the circular polarization radiation pattern. For example, when the first radiation units are driven as transmission antennas for transmitting the vertical polarization radiation pattern, the second radiation units may be driven as reception antennas for receiving the horizontal polarization radiation pattern.

Accordingly, since the first radiation units 200*gc* and the second radiation units 200*gd* do not interfere with each other, the first radiation units 200*gc* and the second radiation units 200*gd* can be positioned close to each other along the periphery of the board unit 110*g*.

Various embodiments of the present disclosure disclosed in this specification and the drawings are merely specific examples presented in order to easily describe technical details of the present disclosure and to help the understanding of the present disclosure, and are not intended to limit the scope of the present disclosure. Therefore, it should be construed that, in addition to the embodiments disclosed herein, all modifications and changes or modified and changed forms derived from the technical idea of various embodiments of the present disclosure fall within the scope of the present disclosure.

What is claimed is:

1. An antenna device comprising:

a board unit having a width, a top surface and a bottom surface;

a radiator arranged in a width direction along a periphery of the board unit so as to generate an electric field and a magnetic field in the width direction, and protruding perpendicularly to the width between the top surface and the bottom surface; and a plurality of radiation patches protruding in a direction horizontal to the top surface and the bottom surface.

2. An antenna device comprising:

a board unit having a width, a top surface and a bottom surface;

a power feeding unit provided in the board unit; and radiation units connected to the power feeding unit to be fed with a power feeding signal, the radiation units being arranged to face each other within the width of the board unit along a periphery of the board unit, and wherein each radiation unit includes a radiator protruding perpendicularly to the width between the top surface and the bottom surface, and a plurality of radiation patches protruding in a direction horizontal to the top surface and the bottom surface.

3. The antenna device of claim 2, wherein each of the radiation units includes an open-open structure formed from:

the radiator connected with the power feeding unit; and the radiation patches arranged to face each other in the radiator.

4. The antenna device of claim 3, wherein a length of the radiation patches have an electric length of $N*(\lambda/2)$, and wherein N is a natural number and $\lambda$ is a resonance frequency of the antenna device.

5. The antenna device of claim 3, wherein the radiation patches have an open-short structure wherein the radiation patches face each other within the width of the board unit.

6. The antenna device of claim 5, wherein a length of the radiation patches has an electric length of $N*(\lambda/4)$, and wherein N is a natural number and $\lambda$ is a resonance frequency of the antenna device.

7. The antenna device of claim 2, wherein the radiation units include first and second radiators positioned on a peripheral surface of the board unit and arranged to face each other parallel to each other within the width of the board unit, the first radiator includes a radiation patch connected with the power feeding unit and protruding in a longitudinal direction of the board unit, and the second radiator includes first and second radiation patches spaced apart from the first radiator to face the first radiator parallel to the first radiator above and below the first radiator.

8. The antenna device of claim 7, wherein the first and second radiation patches are connected through via holes laminated in plural layers in the width of the board unit and connected with each other.

9. The antenna device of claim 7, wherein, in the first radiation patch, a first electric field is generated in a direction perpendicular to a first surface of the first radiation patch, and in the second radiation patch, a second electric field is generated in a direction perpendicular to a second surface of the second radiation patch so that vertically polarized waves are generated between the first radiation patch and the first radiator, and between the second radiation patch and the first radiator.

10. The antenna device of claim 9, wherein a frequency of the antenna device is adjusted according to a length of the first and second radiation patches.

11. The antenna device of claim 2, wherein the radiation unit is positioned on a peripheral surface of the board unit and includes a radiator and a ground unit provided within the width of the board unit to face the peripheral surface of the board unit and to face each other, the radiator includes a column portion formed to be spaced apart from an end of the board unit and connected with the power feeding unit, and radiation plates protruding toward the board unit at opposite ends of the column portion, and the ground unit includes a plurality of radiation patches protruding toward the column portion along a width direction of the board unit.

12. The antenna device of claim 11, wherein the column portion is connected by via holes laminated in plural layers and connected with each other.

13. The antenna device of claim 11, wherein vertically polarized waves are generated due to an electric field generated between the radiator and the ground unit.

14. The antenna device of claim 11, wherein a frequency of the antenna device is adjusted according to a length of the radiation plate.

15. The antenna device of claim 2, wherein the radiation unit includes:

radiation members positioned on a peripheral surface of the board unit and arranged to face each other within the width of the board unit; and one or more guide radiation members provided in a direction away from the peripheral surface of the board unit, and arranged close to the radiation members.

16. The antenna device of claim 15, wherein the radiation members include first and second radiators arranged to be parallel to each other along the longitudinal direction within the width of the board unit.

17. The antenna device of claim 16, wherein the guide radiation members include first and second guide patches arranged to be closely parallel to the first and second radiators to face each other.

18. The antenna device of claim 17, wherein the first and second guide patches are connected with each other by via holes laminated in plural layers and connected with each other.

19. The antenna device of claim 17, wherein a frequency of the antenna device is adjusted according to a length of the first and second radiators and a length of the first and second guide patches.

20. The antenna device of claim 15, wherein a directivity of the antenna is adjusted according to a mounting number of the guide radiation members.

21. The antenna device of claim 2, wherein the radiation unit is positioned on a peripheral surface of the board unit, and includes a first radiation and a second radiation arranged to face each other within the width of the board unit, and generates an electric field in a direction horizontal to the board unit and an electric field in a direction vertical to the board unit so as to generate a horizontal polarization radiation pattern and a vertical polarization radiation pattern.

22. The antenna device of claim 21, wherein the first radiator includes a radiation patch connected with the power feeding unit and protruding in a longitudinal direction of the board unit, and the second radiator includes first and second radiation patches spaced apart from the first radiator to face the first radiator parallel to the first radiator above and below the first radiator to generate a radiation pattern having horizontally polarized waves and vertically polarized waves.

23. The antenna device of claim 22, wherein the first radiation patch includes:

a first vertical polarization radiation portion protruding in one direction from the peripheral surface of the board unit; and a first horizontal polarization radiation portion extending from one end of the first vertical polarization radiation portion and bent in a direction from the one end to the other end of the first vertical polarization radiation portion, and wherein the second radiation patch includes:

a second vertical polarization radiation portion protruding in one direction from the peripheral surface of the board unit and provided to face the first vertical polarization radiation portion; and a second horizontal polarization radiation portion bent and extending in a direction from the other end to one end of the second vertical polarization radiation portion.

24. The antenna device of claim 2, wherein the radiation unit is positioned on the peripheral surface of the board unit and includes a radiator and a ground unit provided within the width of the board unit to face the peripheral surface of the board unit and to face each other, and the power feeding unit includes a first power feeding line connected to the radiator so as to provide a horizontal polarization power feeding signal between the radiator and the ground unit, and a second power feeding line connected to the radiator to provide a vertical polarization power feeding signal between the radiator and the ground unit.

25. The antenna device of claim 24, wherein the first and second power feeding lines are selectively turned ON/OFF.

26. The antenna device of claim 25, wherein the radiation unit generates:

a horizontal polarization radiation pattern when the first power feeding line is turned ON and the second power feeding line is turned OFF, a vertical polarization radiation pattern when the first power feeding line is turned OFF and the second power feeding lines is turned ON, a diagonal polarization radiation pattern when the first power feeding line and the second power feeding line are turned ON, and a circular polarization radiation pattern when the first power feeding line and the second power feeding line are turned on at 90° intervals.

27. The antenna device of claim 24, wherein the radiator includes a column portion formed to be spaced apart from an end of the board unit and connected with the power feeding unit, and radiation plates protruding toward the board unit at opposite ends of the column portion, and the ground unit includes a plurality of radiation patches protruding toward the column portion along a width direction of the board unit.

28. The antenna device of claim 24, wherein the radiation unit includes:

first radiation units arranged along the peripheral surface of the board unit to be spaced apart from each other; and second radiation units, each of which is disposed between each two adjacent first radiation units, and wherein the first radiation units are provided for use in both transmission and reception of a first frequency band, and the second radiation units are provided for use in both transmission and reception of a second frequency band.

29. The antenna device of claim 28, wherein the first radiation units and the second radiation units are selectively turned ON/OFF according to transmission/reception of the first frequency band or the second frequency band.

30. The antenna device of claim 24, wherein the radiation unit includes:

first radiation units arranged along the peripheral surface of the board unit to be spaced apart from each other; and second radiation units, each of which is disposed between each two adjacent first radiation units, and wherein one of the first radiation units and the second radiation units is provided as a transmission antenna, and a remaining one is provided as a reception antenna.

31. The antenna device of claim 30, wherein the first radiation units are configured to transmit or receive at least one of a vertical polarization radiation pattern, a horizontal polarization radiation pattern, a diagonal polarization radiation pattern, and a circular polarization radiation pattern, and the second radiation units are configured to transmit or receive a pattern different from that transmitted or received by the first radiation units and to transmit or receive at least one pattern among the vertical polarization radiation pattern, the horizontal polarization radiation pattern, the diagonal polarization radiation pattern, and the circular polarization radiation pattern.

32. An antenna device comprising:

a board unit having a width, a top surface and a bottom surface;

a power feeding unit provided in the board unit; and first and second radiators connected to the power feeding unit to be provided with a power feeding signal, the first and second radiators being provided to face each other along a periphery of the board unit and within the width of the board unit, wherein the first radiator includes a radiation patch connected with the power feeding unit and protruding in a longitudinal direction and in a direction horizontal to the top surface and the bottom surface of the board unit, the second radiator includes first and second radiation patches spaced apart from the first radiator to face the first radiator and being parallel to the first radiator above and below the first radiator in a direction horizontal to the top surface and the bottom surface, and the first radiator and the second radiator generate a vertical polarization radiation pattern.

33. An antenna device comprising:

a board unit having a width, a top surface and a bottom surface;

a power feeding unit provided in the board unit; and first and second radiators connected to the power feeding unit to be provided with a power feeding signal, positioned along a peripheral surface of the board unit, and provided to face the peripheral surface of the board unit and face each other within the width of the board unit, wherein the first radiator includes a column portion formed to be spaced apart from an end of the board unit and connected with the power feeding unit, and plates protruding from opposite ends of the column portion toward the board unit in a direction horizontal to the top surface and the bottom surface, the second radiator includes a plurality of radiation patches protruding toward the column portion along a width direction of the board unit in a direction horizontal to the top surface and the bottom surface, and the first radiator and the second radiator generate a vertical polarization radiation pattern.

34. An antenna device comprising:

a board unit having a width, a top surface and a bottom surface;

a power feeding unit provided in the board unit;

radiation members connected to the power feeding unit to be provided with a power feeding signal, and provided to face each other along a periphery of the board unit and within the width of the board unit; and one or more guide radiation members provided in a direction away from the peripheral surface of the board unit and in a direction horizontal to the top surface and the bottom surface, and arranged close to the radiation members, wherein the radiation members generate a vertical polarization radiation pattern, and the guide radiation member adjusts a directivity of the antenna device.

35. An antenna device comprising:

a board unit having a width, a top surface and a bottom surface;

a power feeding unit provided in the board unit; and first and second radiation patches connected to the power feeding unit to be supplied with a power feeding signal protruding in a direction horizontal to the top surface and the bottom surface, provided to face each other along a periphery of the board unit and within the width of the board unit, and generating an electric field in a direction horizontal to the board unit and an electric field in a direction vertical to the board unit so as to generate a horizontal polarization antenna pattern and a vertical polarization antenna pattern.

36. An antenna device comprising:

a board unit having a width, a top surface and a bottom surface;

a power feeding unit provided in the board unit; and a radiation unit including first and second radiators connected to the power feeding unit to be provided with a power feeding signal, positioned along a peripheral surface of the board unit, and provided to face the peripheral surface of the board unit and face each other within the width of the board unit, wherein the power feeding unit includes a first power feeding line connected to the first radiator to provide a horizontal polarization power feeding signal between the first radiator and the second radiator, and a second power feeding line connected to the first radiator to provide a vertical polarization power feeding signal between the first radiator and the second radiator, and wherein a plurality of radiation patches protrude in a direction horizontal to the top surface and the bottom surface, and at least one of a vertical polarization radiation pattern, a horizontal polarization radiation pattern, a diagonal polarization radiation pattern, and a circular polarization radiation pattern is generated according to selective ON/OFF of the first and second power feeding lines.

* * * * *